US012435953B2

(12) United States Patent
Humphries

(10) Patent No.: US 12,435,953 B2
(45) Date of Patent: Oct. 7, 2025

(54) SCOPE MOUNT APPARATUS AND METHOD

(71) Applicant: Christopher Allen Humphries, Somerville, AL (US)

(72) Inventor: Christopher Allen Humphries, Somerville, AL (US)

( * ) Notice: Subject to any disclaimer, the term of this patent is extended or adjusted under 35 U.S.C. 154(b) by 0 days.

(21) Appl. No.: 18/760,342

(22) Filed: Jul. 1, 2024

(65) Prior Publication Data

US 2024/0353202 A1 Oct. 24, 2024

Related U.S. Application Data

(63) Continuation-in-part of application No. 17/500,451, filed on Oct. 13, 2021, now Pat. No. 12,025,406.

(60) Provisional application No. 63/090,805, filed on Oct. 13, 2020.

(51) Int. Cl.
*F41G 11/00* (2006.01)

(52) U.S. Cl.
CPC ..... *F41G 11/003* (2013.01)

(58) Field of Classification Search
CPC ..... F41G 11/003
See application file for complete search history.

(56) References Cited

U.S. PATENT DOCUMENTS 2,401,825 A * 6/1946 Gruver ..... F41G 11/005 42/127
2,436,453 A * 2/1948 Schulz ..... F41G 11/001 42/148
2,645,855 A * 7/1953 Ivy ..... F41G 11/001 42/126
2,743,526 A * 5/1956 Ivy ..... F41G 11/002 42/126
2,763,930 A * 9/1956 Ivy ..... F41G 11/001 42/127
3,260,001 A * 7/1966 Weaver ..... F41G 11/003 42/124
3,463,430 A * 8/1969 Jimenez ..... F41G 11/003 248/229.15
3,671,000 A * 6/1972 Williams ..... F41G 11/003 248/224.61
3,835,565 A * 9/1974 Weast ..... F41G 11/003 42/124
3,875,675 A * 4/1975 Krisay ..... F41G 11/003 42/127
4,026,055 A * 5/1977 Weast ..... F41G 11/003 D22/110
4,418,487 A * 12/1983 Strahan ..... F41G 11/001 42/125

(Continued)

*Primary Examiner* — Michelle Clement
(74) *Attorney, Agent, or Firm* — HSML P.C.

(57) ABSTRACT

A scope mount apparatus for attaching an optical scope to a firearm is provided. The scope mount apparatus includes at least one base with at least one fastening element for attaching the base to the firearm. The scope mount apparatus also includes two scope rings operatively connected to the at least one base. An integral sighting system is mounted with respect to the base. The scope mount apparatus is configured such that an unobstructed line of sight extends between the scope rings and the base. The unobstructed line of sight contacts or intersects the sighting system so that a user of the firearm has the option of using either a scope in the scope rings or the integrated sighting system to aim at a target.

16 Claims, 18 Drawing Sheets

(56) References Cited

U.S. PATENT DOCUMENTS 4,429,468 A * 2/1984 Jimenez ..... F41G 11/003 42/111
4,501,071 A * 2/1985 Manske ..... F41G 11/001 42/127
4,509,282 A * 4/1985 McMillon ..... F41G 11/003 D22/110
4,688,345 A * 8/1987 Kilgour ..... F41G 11/003 42/127
4,841,659 A * 6/1989 Williams ..... F41G 1/10 D22/109
4,873,779 A * 10/1989 Ellison ..... F41G 11/001 42/124
4,941,277 A * 7/1990 Lawlor ..... F41G 11/003 42/111
5,355,607 A * 10/1994 Klotz ..... F41G 11/003 42/124
5,425,191 A * 6/1995 Taylor ..... F41G 11/001 42/124
5,595,011 A * 1/1997 Gorslin ..... F41G 11/001 42/112
5,671,561 A * 9/1997 Johnson ..... F41G 1/35 42/114
5,694,712 A * 12/1997 Plonka ..... F41G 11/003 42/124
5,787,630 A * 8/1998 Martel ..... F41G 11/003 42/127
5,806,228 A * 9/1998 Martel ..... F41G 11/003 42/124
6,336,285 B1 * 1/2002 Baumer ..... F41G 1/00 42/141
6,338,219 B1 * 1/2002 Watson, Jr. ..... F41G 1/08 42/130
6,701,660 B2 * 3/2004 Stover ..... F41G 11/003 42/126
6,886,288 B1 * 5/2005 Yocum ..... F41G 11/003 42/127
7,272,904 B2 * 9/2007 Larue ..... F41G 11/003 292/145
7,444,776 B2 * 11/2008 Adams ..... F41G 11/001 42/127
7,982,858 B2 * 7/2011 Holmberg ..... F41C 27/00 356/5.01
8,151,508 B1 * 4/2012 Moore ..... F41G 11/001 42/124
8,196,332 B2 * 6/2012 Brentzel ..... F41G 11/003 42/124
D668,730 S * 10/2012 Casas Salva ..... F41G 11/003 D22/108
8,336,247 B2 * 12/2012 Haering ..... F41G 11/003 42/111
8,393,108 B1 * 3/2013 Wilson ..... F41G 11/003 42/111
8,397,421 B2 * 3/2013 Ding ..... F41G 11/003 42/127
8,701,331 B2 * 4/2014 Schneider ..... F41G 11/003 42/124
8,707,610 B2 * 4/2014 Troy ..... F41G 11/003 42/124
8,720,103 B2 * 5/2014 Schultz ..... F41G 11/003 42/127
8,911,162 B2 * 12/2014 Kuehl ..... F16M 11/2092 396/428
9,052,160 B1 * 6/2015 Gordon ..... B23P 6/00
10,254,083 B2 * 4/2019 Jahromi ..... F41G 1/38
10,837,737 B1 * 11/2020 Wright ..... F41G 1/08
10,883,798 B1 * 1/2021 Chang ..... F41G 11/003
10,935,347 B2 * 3/2021 Reis Green ..... F41G 1/38
11,237,379 B2 * 2/2022 McCoy, II ..... F41G 1/38
2001/0045046 A1 * 11/2001 Otteman ..... F41G 1/38 42/136
2003/0154641 A1 * 8/2003 Stover ..... F41G 11/003 42/124
2007/0266611 A1 * 11/2007 Stover ..... F41G 11/004 42/124
2008/0134561 A1 * 6/2008 Clouser ..... F41G 1/42 42/127
2009/0133311 A1 * 5/2009 Hollenbach ..... F41G 11/001 42/124
2009/0307956 A1 * 12/2009 Barret ..... F41G 1/38 42/125
2011/0005119 A1 * 1/2011 Neergaard ..... F41G 1/08 42/111
2014/0259854 A1 * 9/2014 Williams ..... F41G 11/003 42/124
2016/0069642 A1 * 3/2016 Williams ..... F41G 1/387 29/428
2018/0073840 A1 * 3/2018 Kristoffersen ..... F41G 1/16
2018/0306554 A1 * 10/2018 Patton ..... F41G 1/545
2019/0249952 A1 * 8/2019 Odle ..... F41G 1/26
2020/0025522 A1 * 1/2020 Zimmer ..... F41G 11/001

* cited by examiner

SCOPE MOUNT APPARATUS AND METHOD

CROSS-REFERENCE TO RELATED APPLICATION

This application is a continuation-in-part of U.S. patent application Ser. No. 17/500,451, Oct. 13, 2021, which claims the benefit of U.S. Provisional Patent Application No. 63/090,805, filed Oct. 13, 2020, both of which are hereby incorporated by reference in their entireties.

TECHNICAL FIELD

This disclosure relates to mounts for attaching an optical scope to a firearm.

BACKGROUND OF THE INVENTION

Firearms typically employ sights to enable a shooter to aim the firearm to increase the likelihood that the projectile from the firearm impacts the shooter's intended target. For example, a firearm may have an optical sight, which is sometimes referred to as a "telescopic sight" or a "scope," mounted thereto. An optical sight employs lenses or other optical elements to magnify a target. Iron sights include two members of various shapes spaced along the length of the firearm; a user employs the iron sights by aligning the two members, or features thereof, with a target. Other types of sights include "red dot" sights and laser sights.

SUMMARY

According to a first aspect of the disclosure, a scope mount apparatus is provided herein. The scope mount apparatus is for use with a firearm having a receiver, a barrel operatively connected to the receiver, and an accessory attachment element mounted to at least one of the receiver and barrel. The scope mount apparatus includes first and second scope rings, at least one base, and at least one fastener operatively connected to the base and engageable with the accessory attachment element to attach the base to the firearm.

Structure interconnects the at least one base and the first and second scope rings. The scope mount apparatus also includes an iron sight system having a rear iron sight member and a front iron sight member. The front and rear iron sight members are mounted with respect to the at least one base and not mounted to the firearm. The sighting system is positioned such that, when the at least one fastener is operatively connected to the accessory attachment element, a line extends between the scope rings and the at least one base portion and extends through the sighting system. The rear iron sight member is selectively laterally movable relative to the at least one base.

Each type of sighting system has characteristics that make it a preferred option in different shooting scenarios or conditions. For example, iron sights and red dot sights are typically preferred for short-range shooting. The scope mount apparatus provides a shooter with the option of using the integral sight system in short-range shooting where the scope would be less effective. The integral sight system may also facilitate spotting a distant target that would be difficult to find in the scope due to the scope's narrow field of vision. Thus, the scope mount apparatus provided herein has beneficial application in hunting scenarios, home defense scenarios, and law enforcement scenarios.

Thus, the scope mount apparatus provides a shooter with the option of using either a scope retained by the scope rings or the iron sights. In one embodiment, the line of sight (as viewed from the perspective of a shooter employing the firearm to which the scope mount apparatus is attached) through the iron sights is directly below the scope so that no lateral head movement is required for a shooter to switch between employing the integral sighting system and employing the scope. The scope mount apparatus provided herein improves upon the prior art by enabling lateral adjustability of the rear iron sight member, which is critical for ensuring shooting accuracy.

In one embodiment, the minimum clearance between the scope rings and the base member(s) is 0.605 inches. This minimum clearance improves upon the prior art because 0.605 inches has been found to be desirable to have an adequate field of view around the iron sight members because the scope's objective lens will obstruct at least some of the space between the scope rings and the base members. In one embodiment, when the scope is attached to the scope rings, there is a vertical distance of 0.033 between the objective lens of the scope and the base member, which is achieved by having the 0.605 clearance. The minimum clearance provided herein enables a shooter to use the iron sights and the unobstructed space surrounding the iron sights to locate a target, and then use the scope to aim at the target.

In one embodiment, the iron sight members are unobstructed between two perpendicular directions, which improves upon the prior art by enabling access to the iron sight members with a user's fingers or other tools. Such access allows the user to adjust the iron sight or to remove the iron sight members and install a different iron sight member having a different configuration.

According to a second aspect of the disclosure, a scope mount apparatus that provides a user with the option of using an optical scope or a red dot or laser sight is also provided.

The above features and advantages and other features and advantages of the present disclosure are readily apparent from the following detailed description of the best modes for carrying out the disclosure when taken in connection with the accompanying drawings.

DETAILED DESCRIPTION

Figure 1:
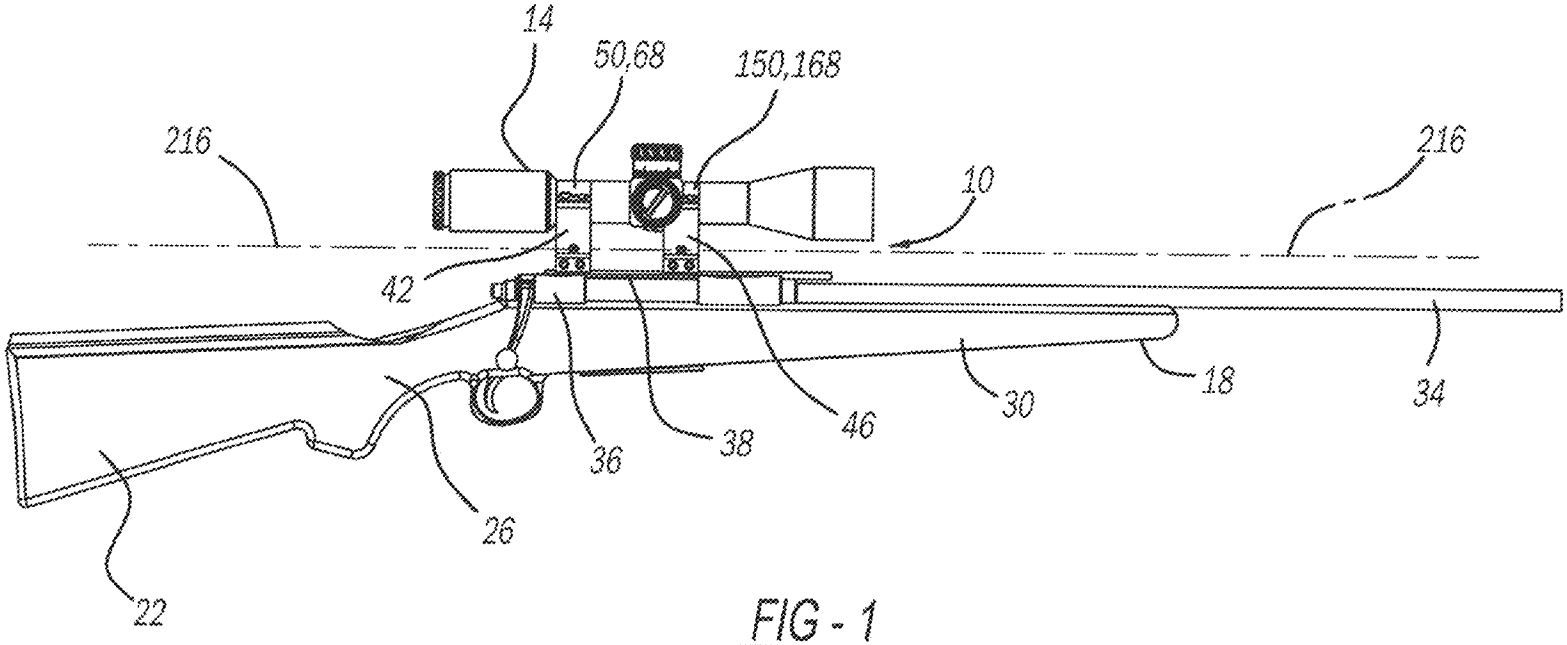
FIG. 1 is a schematic, side view of a scope mount apparatus having first and second scope mounts attached to a firearm and securing an optical scope to the firearm.

Referring to FIGS. 1-5, wherein like reference numbers refer to like components throughout, a scope mount apparatus 10 and its components are schematically depicted. Referring specifically to FIG. 1, the scope mount apparatus 10 is shown connecting an optical scope 14 to a firearm 18. The firearm 18 in the embodiment depicted includes a stock 22, a grip 26, a fore-end 30, and a barrel 34 as understood by those skilled in the art. The top of the barrel 34 or the receiver 36 includes an accessory mounting system 38. Those skilled in the art will recognize a variety of accessory mounting systems 38 that may be employed within the scope of the claimed invention.

In the embodiment depicted, the accessory mounting system 38 is a rail mounted to, or integrally formed on the top of, the firearm's receiver 36. The rail depicted is a picatinny rail, though other rail designs, such as a dovetail rail, may be employed within the scope of the claimed invention. The scope mount apparatus 10 in the embodiment depicted includes a first scope mount assembly 42 and a second scope mount assembly 46.

Figure 2:
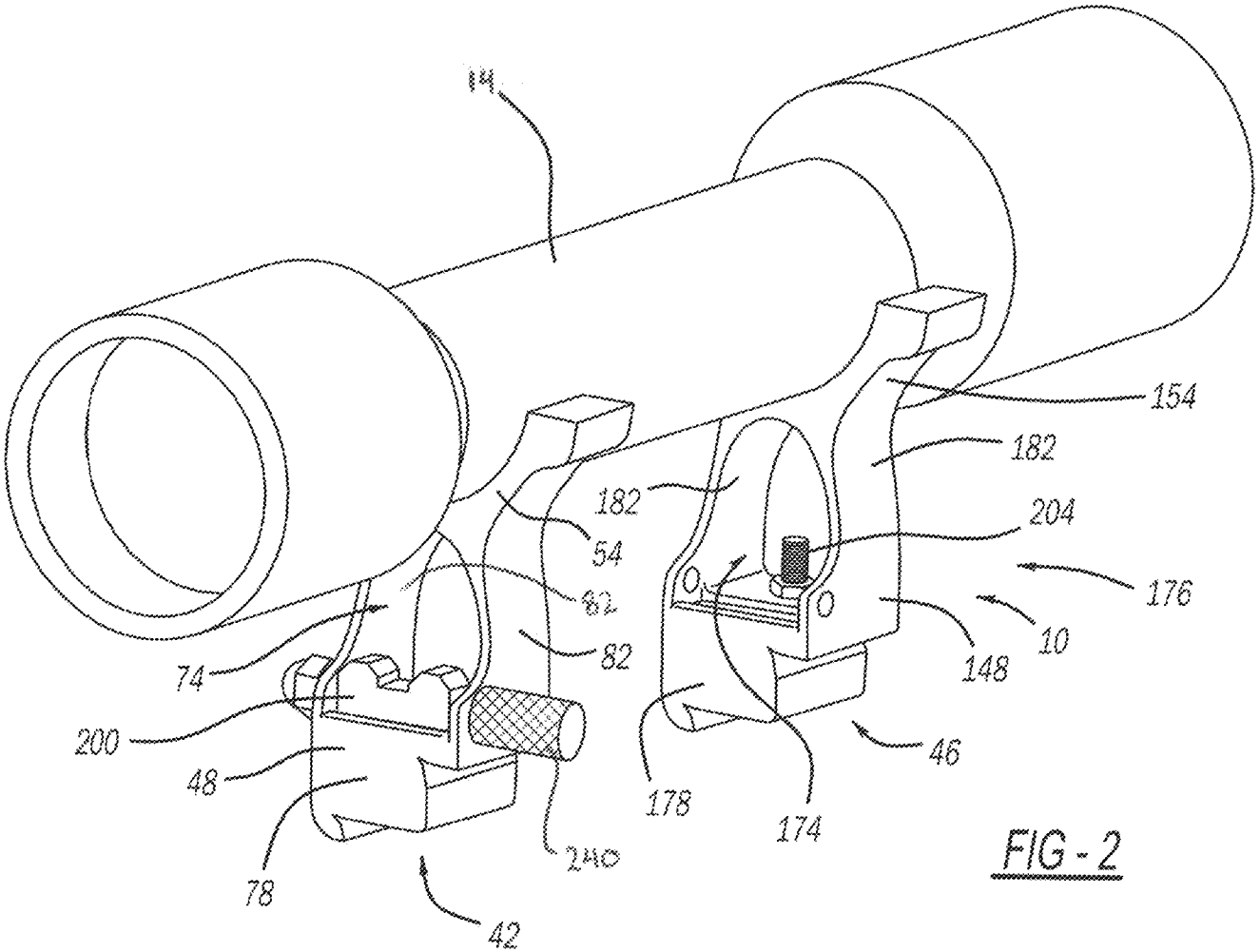
FIG. 2 is a schematic, perspective view of a portion of the scope mount apparatus.
Figure 3:
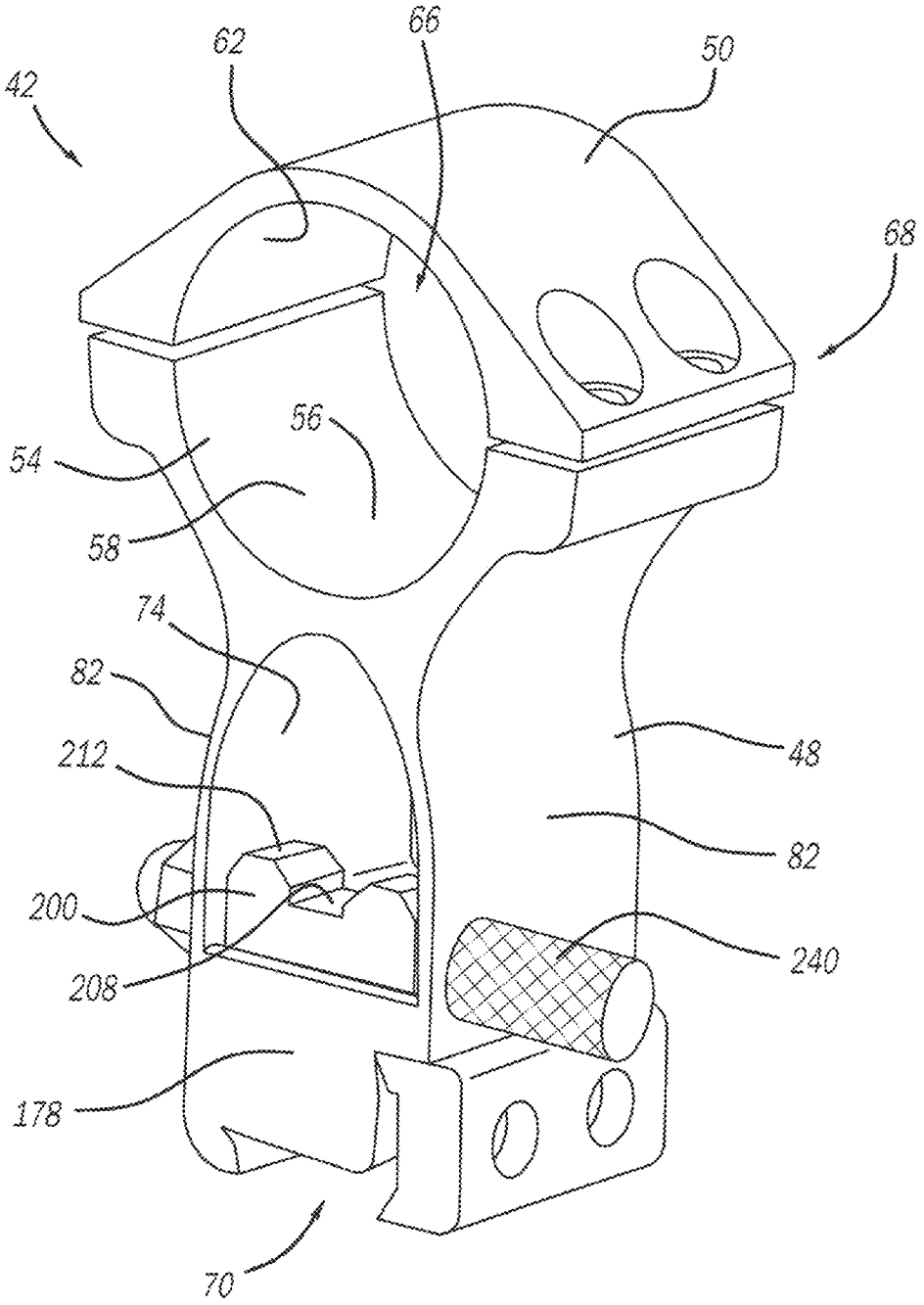
FIG. 3 is a schematic, perspective view of the first scope mount.

Referring to FIGS. 1-3, the first scope mount assembly 42 includes a first scope mount member 48. The first scope mount member 48 includes a first scope mount portion 54, which includes the upper surface 56 of the first scope mount member 48. The upper surface defines a semi-cylindrical cavity 58. The first removable member 50 also includes a surface that defines another semi-cylindrical cavity 62.

The first removable member 50 is selectively attachable to the first scope mount member 48 such that the semi-cylindrical cavity 58 and the other semi-cylindrical cavity 62 cooperate to define a first cylindrical hole 66. In use, the scope 14 extends through the first cylindrical hole 66 between the first removable member 50 and the upper surface 56, as shown in FIG. 1. The first scope mount portion 54 and the removeable member 50 thus cooperate to form a first scope ring 68.

The first scope mount assembly 42 also includes a first fastening element 70 that is engageable with the accessory mounting system 38 to connect the first scope mount assembly 42 to the firearm 18 (as shown in FIG. 1). The first scope mount member 48 also defines a first aperture 74 between the first fastening element 70 and the scope mount portion 54. More specifically, the first scope first scope mount member 48 includes a first base portion 78 that, in the embodiment depicted, cooperates with the fastening element 70 to interface with the accessory mounting system 38. Two walls 82 extend vertically from the base portion 78 and interconnect the base portion 78 and the scope mount portion 54. The base portion 78, the scope mount portion 54, and the two walls 82 define the first aperture 74 therebetween.

The second scope mount assembly 46 contains structure similar to the first scope mount assembly 42. More specifically, and with reference to FIGS. 1-2 and 4, the second scope mount assembly 46 includes a second scope mount member 148. The second scope mount member 148 has a second scope mount portion 154, including upper surface 156. More specifically, the upper surface 156 of the second scope mount member 148 defines a semi-cylindrical cavity 158. The second removable member 150 also includes a surface that defines another semi-cylindrical cavity 162. The second removable member 150 is selectively attachable to the second scope mount member 148 such that the semi-cylindrical cavity 158 and the other semi-cylindrical cavity 162 cooperate to define a second cylindrical hole 166. The scope 14 is retained in the second cylindrical hole 166 between the second removable member 150 and the upper surface 156. The second scope mount portion 154 and the removeable member 150 thus cooperate to form a second scope ring 168. The first and second removable members 50, 150 may be attachable to the first and second members 48, 148 by threaded fasteners or other fastening elements.

The second scope mount assembly 142 also includes a second fastening element 170 that is engageable with the accessory mounting system 38 to connect the second scope mount assembly 46 to the firearm 18 (as shown in FIG. 1). The second scope mount member 148 also defines a second aperture 174 between the second fastening element 170 and the scope mount portion 154. More specifically, the second scope mount member 148 includes a second base portion 178 that, in the embodiment depicted, cooperates with the second fastening element 170 to interface with the accessory mounting system 38. Two walls 182 extend vertically from the base portion 178 and interconnect the base portion 178 and the scope mount portion 154. The base portion 178, the scope mount portion 154, and the two walls 182 define the second aperture 174 therebetween.

The scope mount apparatus 10 is thus configured to retain an optical scope 14 within the scope rings 68, 168. The scope mount apparatus 10 also includes an integral sight system 176. The integral sight system 176 may have a variety of configurations within the scope of the claimed invention, including, but not limited to, iron sights and "red dot" sights. In the embodiment depicted, the integral sight system 176 is of the "iron sight" configuration. More specifically, the first and second scope mount assemblies 42, 142 cooperate to define an iron sight system.

As understood by those skilled in the art, "iron sights" employ first and second sight members 200, 204. A shooter employs iron sights by aligning the sight members 200, 204, or aligning certain geometric features or characteristics of the sight members, with the shooter's intended target. Those skilled in the art will recognize a variety of iron sight member configurations that may be employed within the scope of the claimed invention. For example, the first sight member 200 may define a circular hole and the second sight member 204 may be a blade; the user aims by aligning the tip of the blade and the center of the circular hole in the first sight member with the target.

In the embodiment depicted, the first sight member 200 is a rectangular plate with a notch 208 formed in the upper surface 212 of the first sight member 200. The first sight member 200 is part of the first scope mount assembly 42 and is mounted to the base portion 78 of the first scope mount member 48 such that the first sight member 200 extends from the base portion 78 into the first aperture 74.

In the embodiment depicted, the second sight member 204 is a pin or post that is part of the second scope mount assembly 46. The second sight member 204 is mounted to the base portion 178 of the second scope mount member 148 such that the second sight member 204 extends from the base portion 178 into the second aperture 174.

When the first and second scope mount assemblies 42, 46 are mounted to the firearm 18 via the accessory mounting system 38, as shown in FIG. 1, the first and second apertures 74, 174 are aligned with each other in the longitudinal direction (relative to the barrel 34). Accordingly, a line of sight 216 parallel to the longitudinal axis of the barrel 34 extends unobstructed through both the first and second apertures 74, 174, and a shooter employing the firearm 18 has the option of using either the sight members 200, 204 or the scope 14. In other words, the scope mount apparatus 10 is configured such that the line of sight 216 is unobstructed for the length of the firearm 18.

Figure 5:
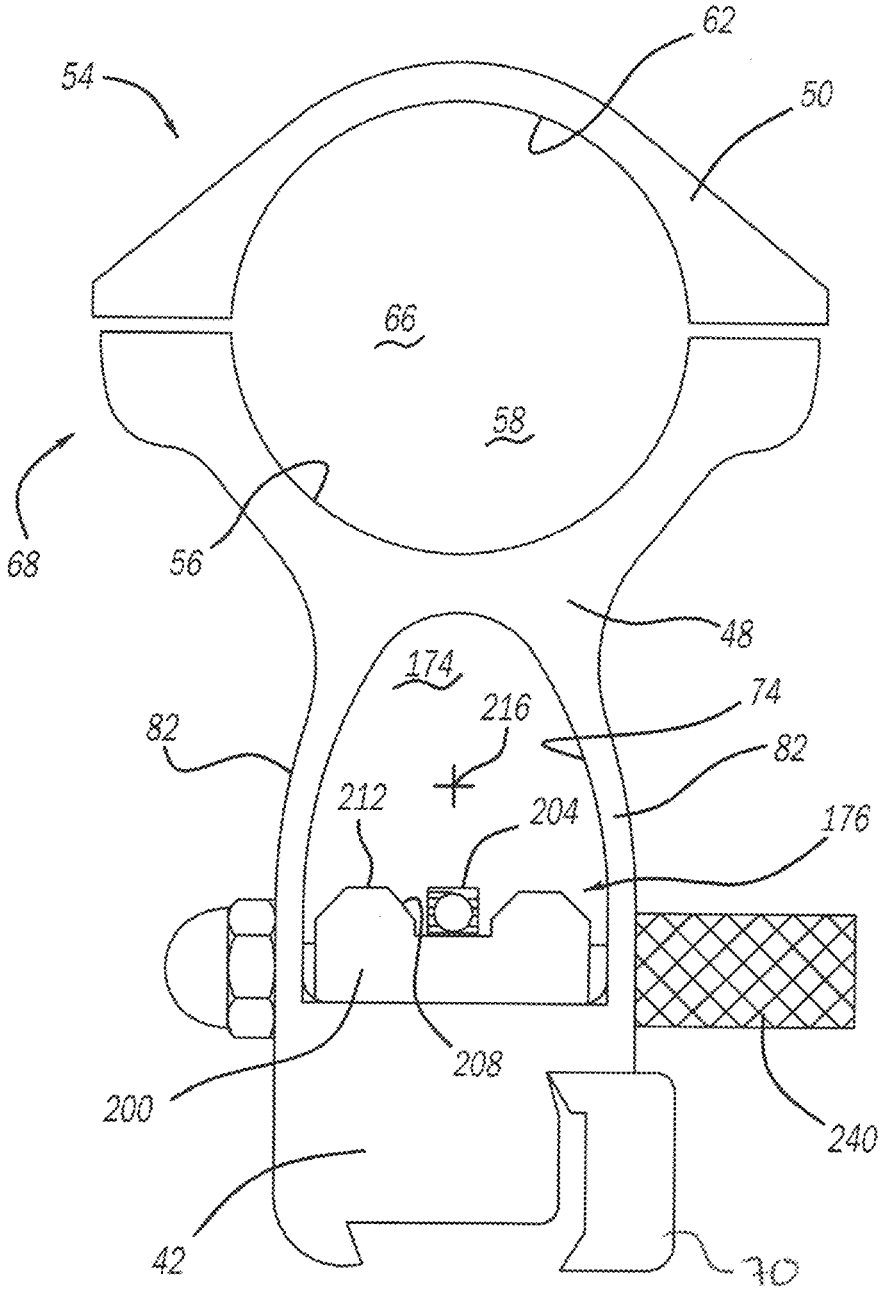
FIG. 5 is a schematic, rear view of the scope mount apparatus.

FIG. 5 schematically depicts the scope mounting apparatus 10 as it would appear to a shooter of the firearm 18 when the first and second scope mount assemblies 42, 46 are connected to the accessory mounting system 38 as shown in FIG. 1. Referring to FIG. 5, the first and second sight members 200, 204 and an intended target are visible to the shooter through the first and second apertures 74, 174, and the second sight member 204 is alignable as seen in FIG. 5 within the notch 208 for aiming purposes, as understood by those skilled in the art.

It should be noted that the scope mount apparatus 10 is configured such that open space (including apertures 74, 174) is between the scope rings 68, 168 and the bases 78, 178. The open space is also between the scope 14 and the rail (i.e., the accessory attachment system 38). The line of sight 216 extends through the open space. The sighting system 176, including iron sight members 200, 204 extend into the open space. It should be noted that, in an embodiment employing a red dot sight, laser sight, etc., the sighting system may be attached to only one of the scope mounts 42, 46 and extend within only one of the apertures 74, 174.

It should also be noted that, for some sighting systems, such as a laser sight, the sighting system may obstruct a line of sight. In such a scenario, a line extends through the open space and the sighting system.

The firearm 18 shown in FIG. 1 does not include iron sights integrally formed or pre-attached to the barrel 34. Accordingly, by attaching the apparatus 10 with the iron sight members 200, 204, the apparatus enables the shooter of the firearm 18 with the option of using either the scope 14 or the iron sights 200, 204. A method of using the apparatus 10 may include obtaining or possessing a firearm 18 without iron sights, installing the first scope mount assembly 42 (with the first sight member 200) to the firearm 18, and installing the second scope mount assembly 46 (with the second sight member 204) to the firearm 18 as shown in the Figures. The method may also include installing the scope 14 to the firearm 18 via the scope mount assembly 10. Installing the scope 14 may include inserting the scope into the first and second cavities 58, 158 and then attaching the members 50, 150 to the first and second scope mount members 48, 148 so that the scope 14 extends through the holes 66, 166.

Figure 4:
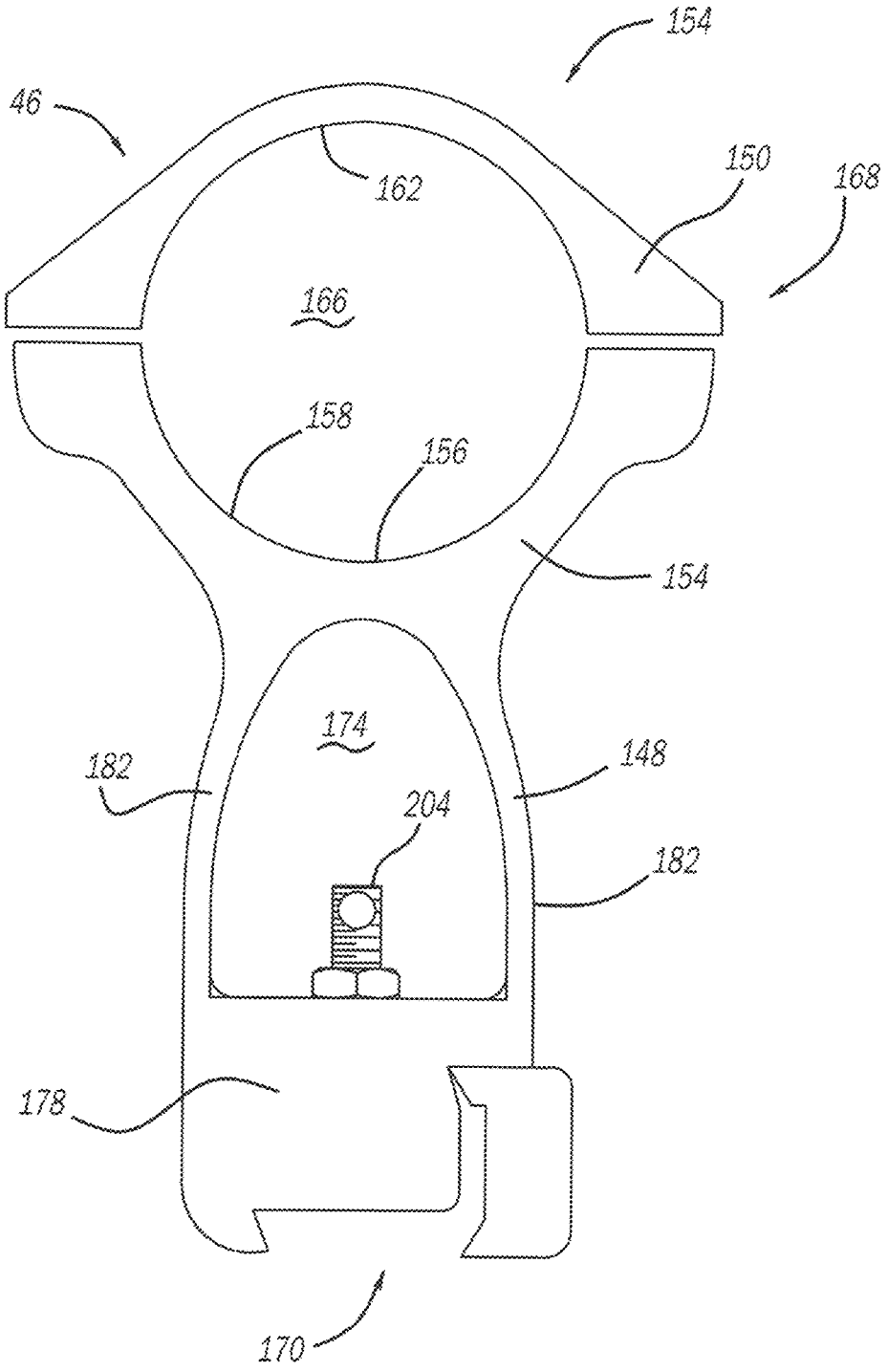
FIG. 4 is a schematic, rear view of the second scope mount.

In the embodiment depicted, the rear sight, i.e., sight member 200, is adjustable left and right (as seen in FIG. 5) by rotating an adjustment pin 240. The front sight, i.e., sight member 204, is a threaded pin and can be adjusted up and down (as seen in FIGS. 4 and 5) by rotating the sight member 204.

It should be noted that the scope mount apparatus 10 protects the iron sight members 200, 204 within the apertures 74, 174. More specifically, the structure of the scope mount members 48, 148 surrounds the sight members 200, 204 on four sides, leaving only the fore and aft directions open and unobstructed. The structure of the scope mount members 48, 148 thus provides some protection from tree branches, etc. when the firearm is carried while hunting while still permitting a shooter to employ the sight members 200, 204 to aim at a target.

It should also be noted that, although the scope mount apparatus 10 in the embodiment depicted includes two separate scope mount assemblies 42, 46, each defining a separate scope mount portion 54, 154 forming a scope retention ring and each including a respective sight member 200, 204, the scope mount apparatus 10 may include a single assembly having a single scope mount member within the scope of the claimed invention. For example, and within the scope of the claimed invention, a single scope mount member may define a single aperture having an integral sight system contained therein, and one or more scope rings for retaining an optical scope.

Accordingly, the scope mount apparatus 10 includes first and second scope rings 68, 168 and at least one base. More specifically, the scope mount apparatus 10 includes two bases 78, 178. The scope mount apparatus 10 also includes at least one fastener 70, 170 operatively connected to the at least one base 78, 178 and engageable with the accessory attachment element 38 to attach the at least one base 78, 178 to the firearm 18. The scope mount apparatus 10 also includes structure, i.e., walls 82, 182 interconnecting the at least one base 78, 178 and the first and second scope rings 68, 168.

A sighting system 176 is mounted with respect to the at least one base 78, 178. The sighting system 176 is positioned relative to the scope 14 such that, when the at least one fastener 70, 170 is operatively connected to the accessory attachment element 38, a line 216 extends through the open space between the scope rings 68, 168 and the at least one base portion 78, 178. The line 216 also extends between the scope 14 and the base portions 78, 178. The sighting system extends into the open space (i.e., sight member 200 extends into the aperture 74 and sight member 204 extends into the aperture 174).

Figure 6:
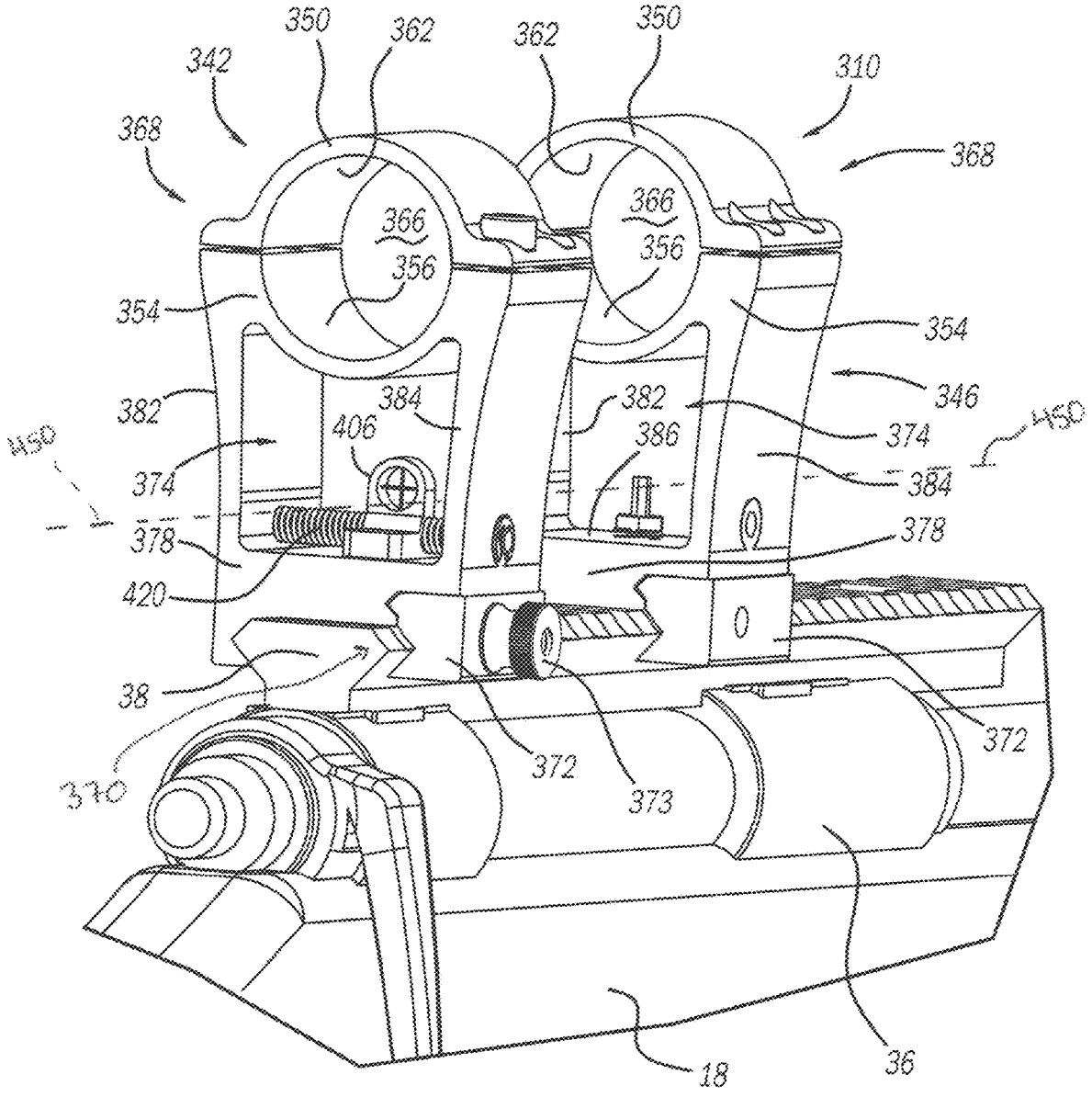
FIG. 6 is a schematic, perspective view of another scope mount apparatus in accordance with the claimed invention.
Figure 7:
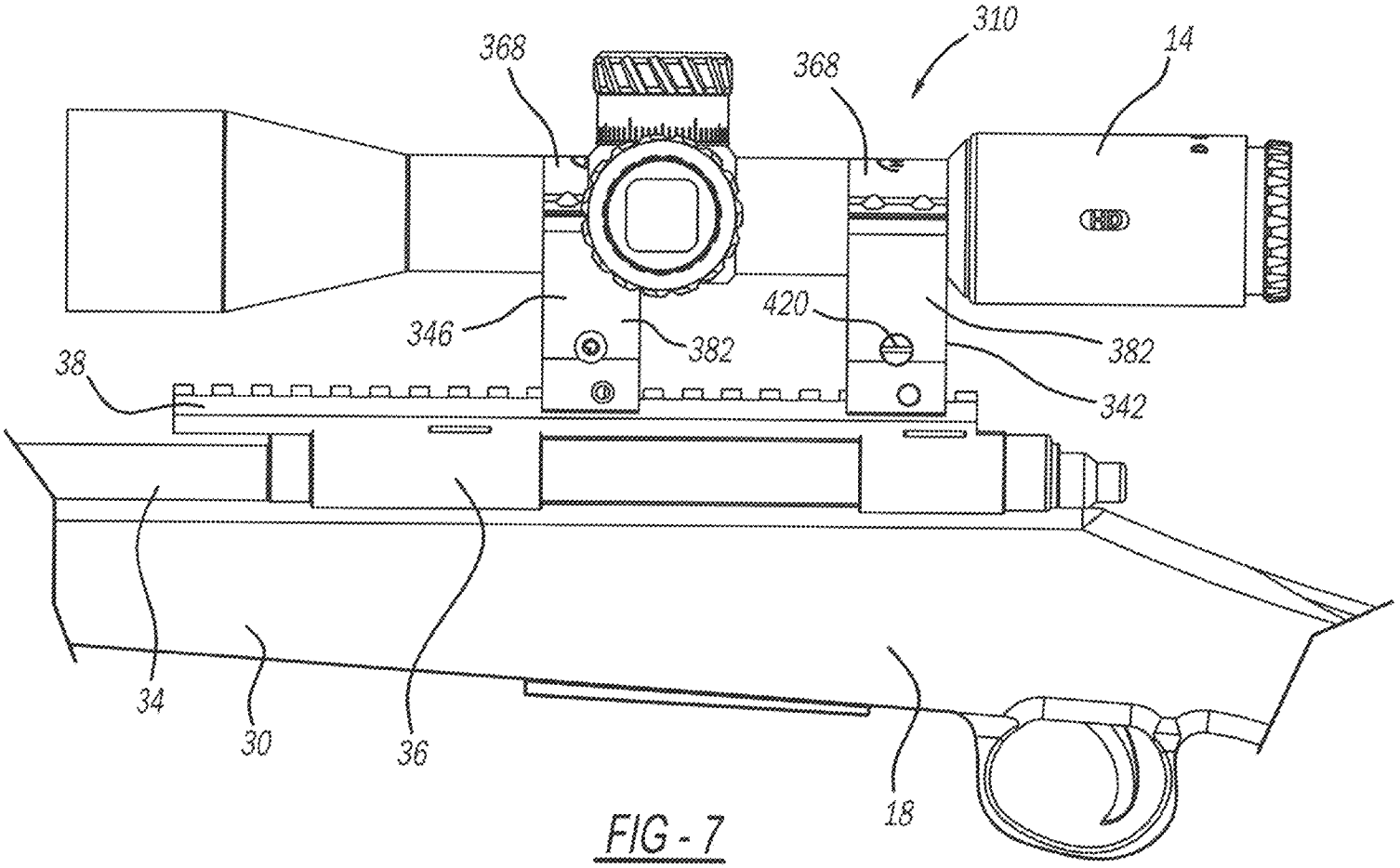
FIG. 7 is a schematic, side view of the scope mount apparatus of FIG. 6.
Figure 8:
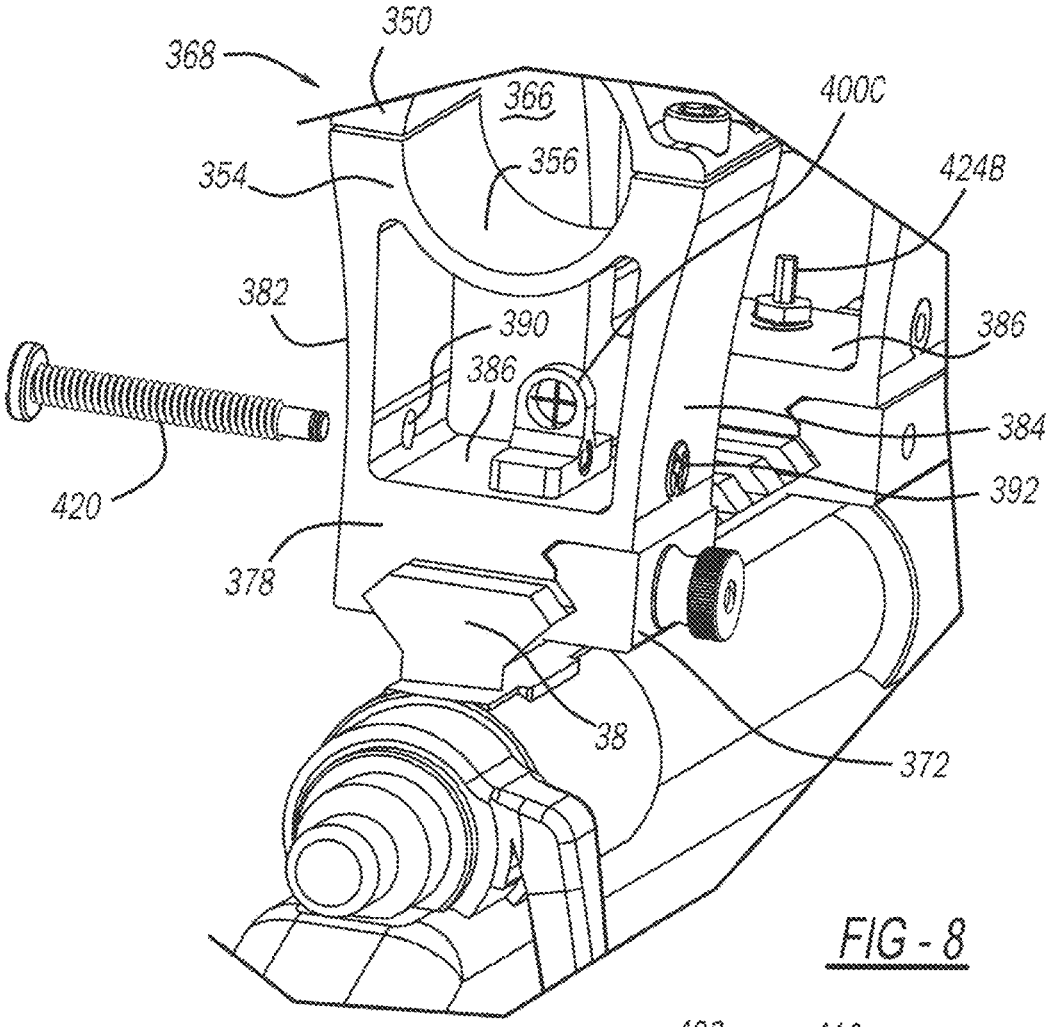
FIG. 8 is a schematic, perspective view of the scope mount apparatus of FIGS. 6 and 7 illustrating the process of installing a first iron sight member.
Figure 9A:
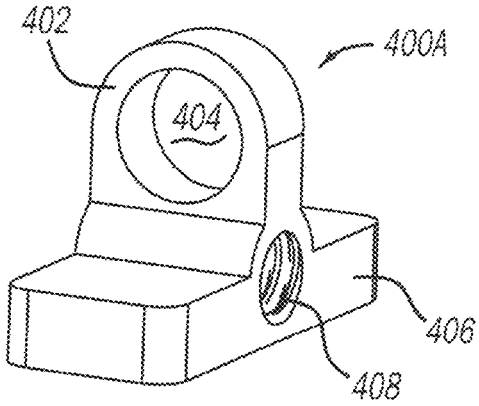
FIGS. 9A-9D schematically depict a first group of differently configured iron sight members.
Figure 9B:
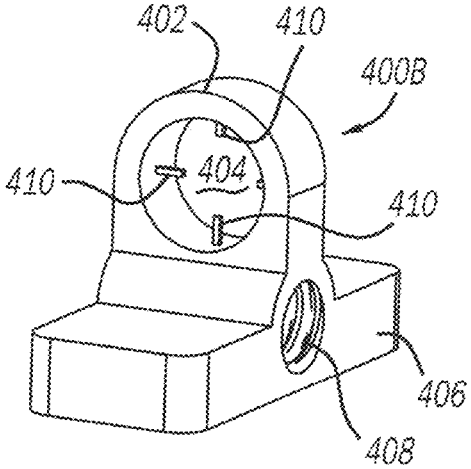
Figure 9C:
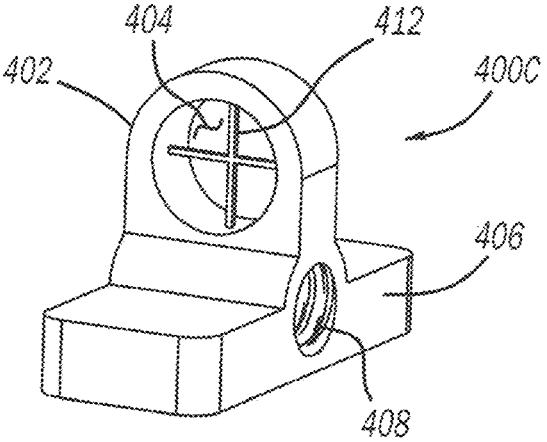
Figure 9D:
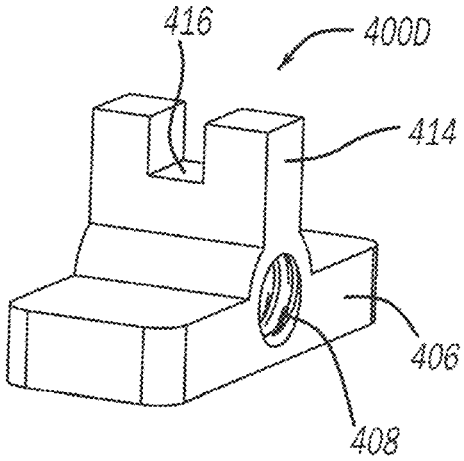
Figure 10:
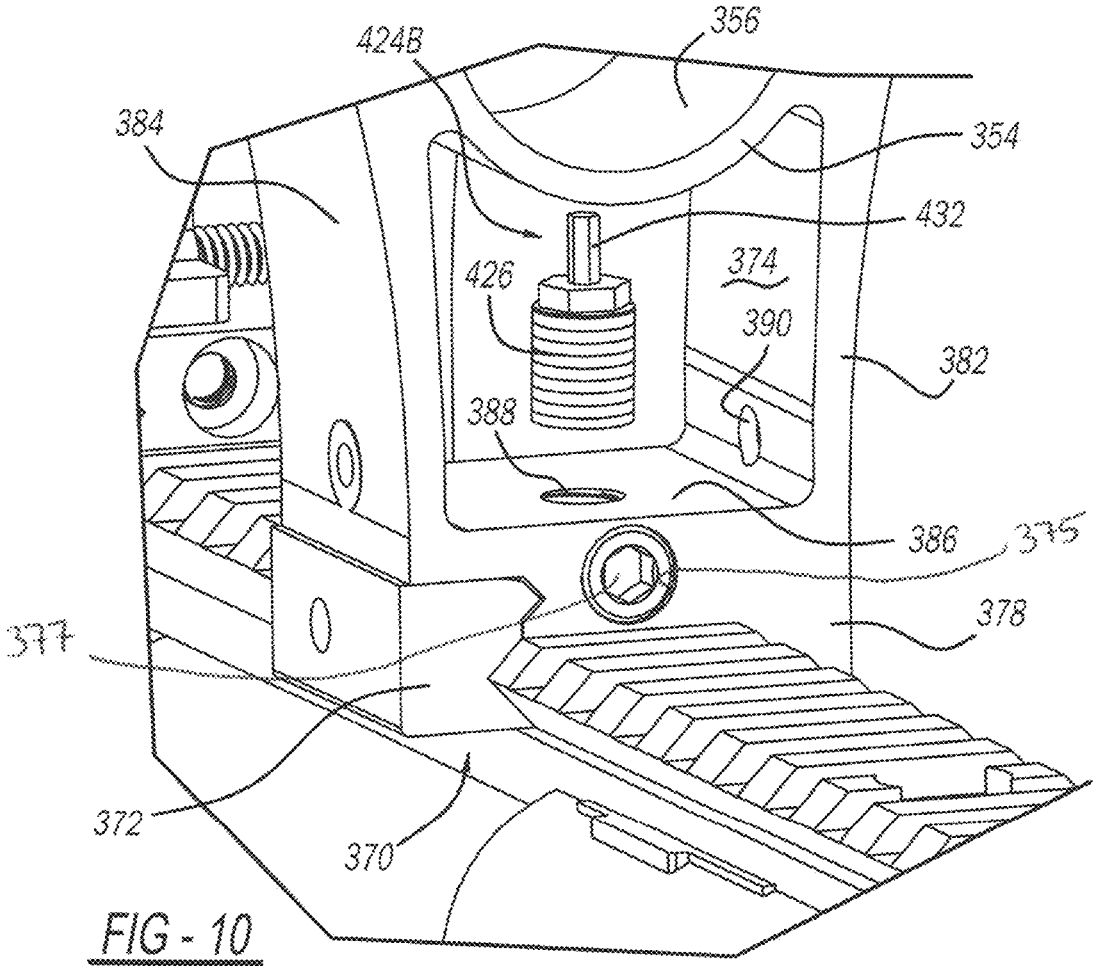
FIG. 10 is a schematic, perspective view of the scope mount apparatus of FIGS. 6 and 7 illustrating the process of installing a second iron sight member.
Figure 11A:
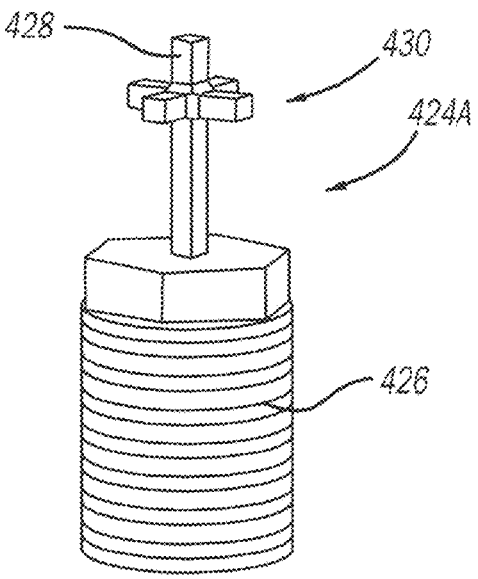
FIGS. 11A-11D schematically depict a second group of differently configured iron sight members.
Figure 11B:
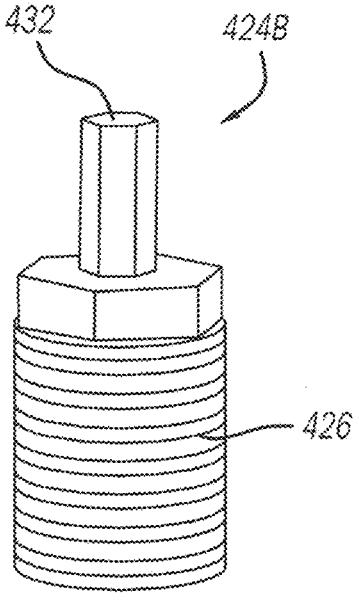
Figure 11C:
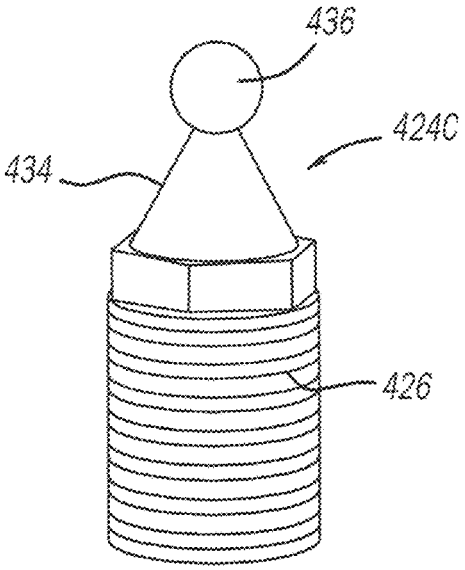
Figure 11D:
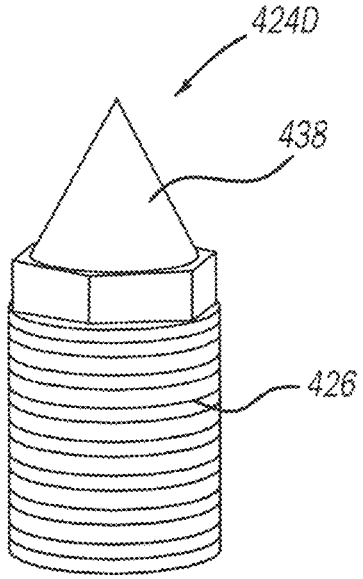

FIGS. 6-11, wherein like reference numbers refer to like components from FIGS. 1-5, schematically depict another scope mount apparatus 310 according to another embodiment. Referring to FIGS. 6 and 7, wherein like reference numbers refer to like components from FIGS. 1-5, the scope mount apparatus 310 is shown connecting a scope 14 to the firearm 18. The scope mount apparatus 310 in the embodiment depicted includes a first scope mount assembly 342 and a second scope mount assembly 346.

The first scope mount assembly 342 includes a first scope mount member 348. The first scope mount member 348 includes a first scope mount portion 354. More specifically, the upper surface 356 of the first scope mount member 348 defines a semi-cylindrical cavity 358. A first removable member 350 also includes a surface that defines another semi-cylindrical cavity 362.

The first removable member 350 is selectively attachable to the first scope mount member 348 such that the semi-cylindrical cavity 358 and the other semi-cylindrical cavity 362 cooperate to define a first cylindrical hole 366. In use, the scope 14 extends through the first cylindrical hole 366 between the first removable member 350 and the upper surface 356, as shown in FIG. 1. The first scope mount portion 354 and the removeable member 350 thus cooperate to form a first scope ring 368.

The first scope mount assembly 342 also includes a first fastening element 370 that is engageable with the accessory mounting system 38 to connect the first scope mount assembly 342 to the firearm 18 (as shown in FIGS. 6 and 7). The first scope mount member 348 also defines a first aperture 374 between the first fastening element 370 and the scope mount portion 354. More specifically, the first scope first scope mount member 348 includes a first base portion 378 that, in the embodiment depicted, cooperates with the first fastening element 370 to interface with the accessory mounting system 38. Two walls 382, 384 extend vertically from the base portion 378 and interconnect the base portion 378 and the scope mount portion 354. The base portion 378, the scope mount portion 354, and the two walls 382, 384 define the first aperture 374 therebetween.

The second scope mount assembly 346 is substantially identical to the first scope mount assembly 342 and includes the same features and elements as the first scope mount assembly 342. The scope mount apparatus thus includes first and second scope rings (i.e., the scope ring 368 of the first scope mount 342 and the scope ring 368 of the second scope mount 346); at least one base (i.e., the base 378 of the first scope mount 342 and the base 378 of the second scope mount 346). At least one fastener 370 is operatively connected to the at least one base 378 and engageable with the accessory attachment element 38 of the firearm 18 to attach the at least one base 378 to the firearm 18.

In the embodiment depicted, the fastener 370 includes is a clamp member 372 that cooperates with the base 378 to clamp onto the picatinny rail. More specifically, the clamp member 372 cooperates with the base 378 to define a cavity that captures the wide portion of the rail therein. The clamp member 372 is selectively movable with respect to the base 378 to permit entry of the rail into the cavity, and is securable with a threaded fastener 373 such that the rail is clamped between the base 378 and the clamp member 372 as shown in the Figures. However, those skilled in the art will recognize a variety of fasteners that may be employed to connect the scope mount apparatus with respect to a firearm within the scope of the claimed invention.

The scope mount apparatus 310 also includes structure (i.e., walls 382, 384 of the first scope mount 342, and the walls 382, 384 of the second scope mount 346) interconnecting the at least one base (i.e., the base 378 of the first scope mount 342 and the base 378 of the second scope mount 346) and first and second scope rings (i.e., the scope ring 368 of the first scope mount 342 and the scope ring 368 of the second scope mount 346).

A sighting system is mounted with respect to the at least one base. In the embodiment depicted, the sighting system is an "iron sight" system and includes a first sight member 400C mounted to the base 378 of the first scope mount 342 and a second sight member 424B mounted to the base 378 of the second scope mount 346. The sighting system (424B, 400C) is positioned such that, when the at least one fastener 372 is operatively connected to the accessory attachment element 38, a line 450 extends between the scope rings 368 and the at least one base portion 378 and extends through the sighting system 400C, 424B.

The scope mount apparatus 310 includes first and second walls (382, 384 of the first scope mount 342) interconnecting a base (i.e., base 378 of the first scope mount 342) and the first scope ring (i.e., scope ring 368 of the first scope mount 342). Third and fourth walls (i.e., walls 382, 384 of the second scope mount 346) interconnect a second base (i.e., base 378 of the second scope mount 346) and the second scope ring (i.e., scope ring 368 of the second scope mount 346).

The first wall, the second wall, the first base, and the first scope ring define a first aperture 374. The third wall, the fourth wall, the second base, and the second scope ring define a second aperture 374. The sighting system is at least partially within at least one of the first and second apertures. More specifically, the first iron sight member 400C is positioned within the first aperture 374 (defined by the first scope mount 342). The second iron sight member 424B is positioned within the second aperture 374 (defined by the second scope mount 346).

In the embodiment depicted, the sight members 400C, 424B are removably mounted with respect to their respective bases 378. Each wall 382 defines a first hole 390. Each wall 384 defines a second hole 392. The first iron sight member 424B defines a third hole 408. The first iron sight member 424B is mounted with respect to the base 378 of the first scope mount 342 by positioned the iron sight member 424B so that the third hole 408 is aligned with the first hole 390 and the second hole 392 and extending a fastening member such as a threaded bolt 420 through the first hole 390, the second hole 392, and the third hole 408. Each base 378 defines a respective planar surface 386 that partially defines the aperture 374. The first iron sight member 400C includes a platform portion 406 rests on the planar surface 386 and through while hole 408 extends.

Each base 378 also defines a respective threaded hole 388 in surface 386. The second iron sight member 424B includes a threaded portion 426 having external threads. The second iron sight member 424B is removably connectable to the base 378 of the second scope mount 346 by engaging the threads of the threaded portion 426 with the threads of the threaded hole 388, i.e., by inserting the threaded portion 426 into the hole 388 and rotating the second iron sight member 424B. In the embodiment depicted, the base 378 defines a hole 375 the extends perpendicularly from hole 388. A screw 377 within the hole 375 is rotated to push against, and thereby secure, the second iron sight member 424B.

The first iron sight member 400C is removable by removing the threaded fastener 420. Similarly, the second iron sight member 424B is removable by rotating the second iron sight member 424B. The removable connections enable a user to customize the sight system. For example, FIGS. 9A-9D schematically depict a group of iron sight members 400A, 400B, 400C, 400D that are differently-configured from one another but have identical interfaces for connecting to the first scope mount 342.

More specifically, each of the members 400A, 400B, 400C, 400D includes a respective platform portion 406 defining a respective hole 408. Iron sight member 400A includes an annulus extending perpendicularly from the platform portion 406 and defining a circular hole 404. Iron sight member 400B is substantially identical to member 400A except that sight member 400B includes partial cross-hairs 410 extending radially inward into the hole 404. Iron sight member 400C is substantially identical to member 400A except that iron sight member 400C includes complete cross-hairs 412 within the hole 404. Iron sight member 400D includes a rectangular plate 414 extending perpendicularly from the platform portion 406. The plate 414 has a notch 416 formed in its upper surface.

FIGS. 11A-11D schematically depict a group of iron sight members 424A, 424B, 424C, 424D that are differently-configured from one another but have identical interfaces for connecting to the second scope mount 346, and more specifically, for insertion into the hole 388 of the second scope mount 346. Iron sight members 424A, 424B, 424C, 424D each have a respective threaded portion 426. Iron sight member 424A includes a stem 428 mounted to threaded portion 426. The step 428 has four stems 430 extending perpendicularly therefrom. Iron sight member 424B includes a single stem 432 extending from the threaded portion 426. Iron sight member 424C includes the frustum 434 of a cone extending from the threaded portion 426. A spherical portion 436 is attached to the narrow end of the frustum 434. Iron sight member 424D includes a cone 438 extending from threaded portion 426.

Thus, each of the sight members 400A-D is mountable to the first scope mount 342, and each of the sight members 424A-D is mountable to the second scope mount 346, thereby enabling a user to select his or her most desirable sighting system configuration. It should be noted that, although iron sights are schematically depicted, a user may also select another sighting system for attachment to the scope mounts, including, but not limited to, laser sights and red dot sights.

Figure 12:
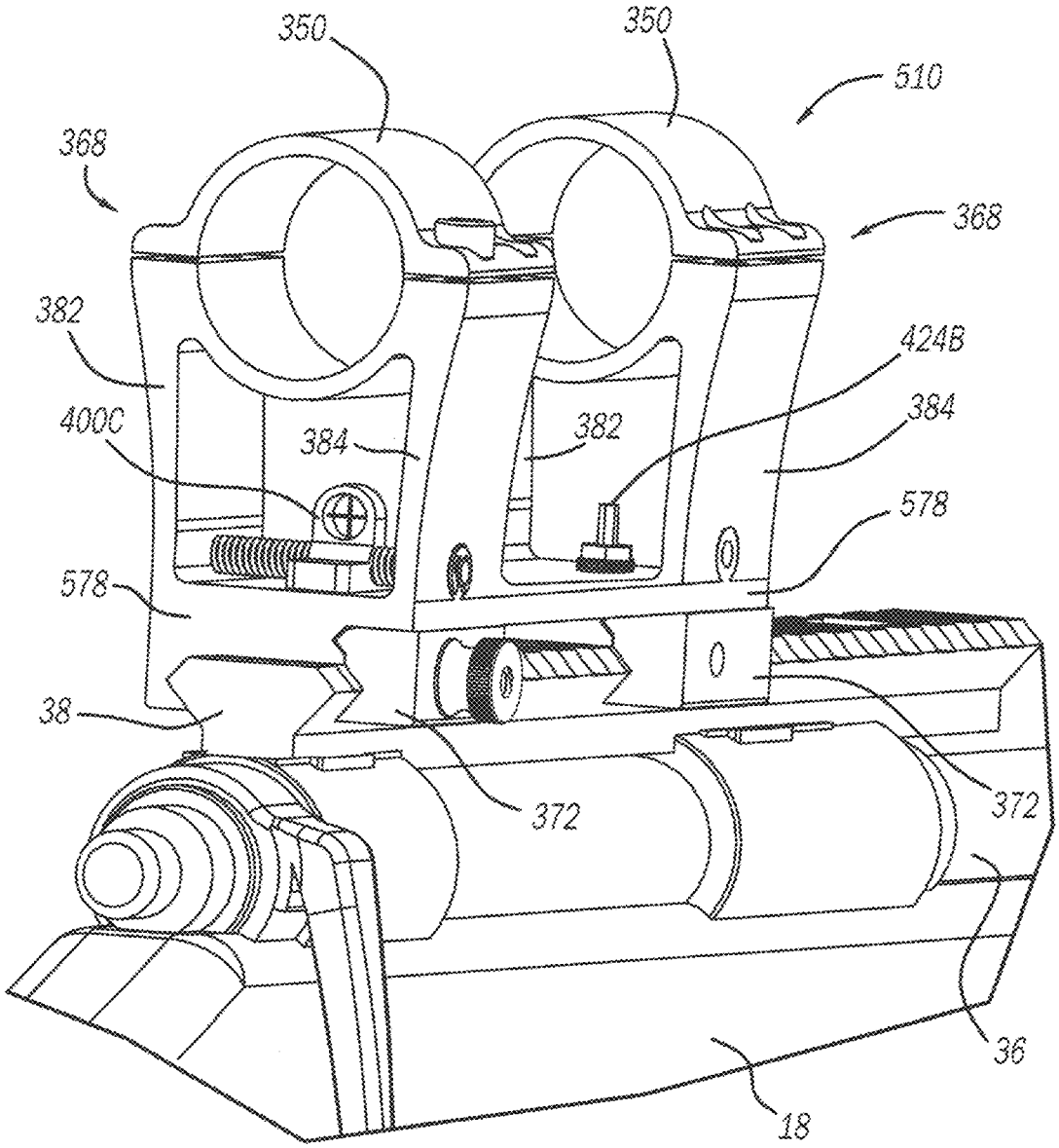
FIG. 12 is a schematic, perspective view of yet another scope mount apparatus in accordance with the claimed invention.

FIG. 12, wherein like reference numbers refer to like components from FIGS. 1-11, schematically depicts yet another scope mount apparatus 510 mounted to the firearm 18. The scope mount apparatus 510 is substantially identical to the scope mount apparatus shown at 310 in FIGS. 6 and 7, except that scope mount apparatus 510 includes a single, unitary base 578 instead of separate base members 378. Walls 382, 384 extend from the single, unitary base 578 to interconnect the two scope rings 368 to the single, unitary base 578. In the embodiment shown, the apparatus 510 includes two clamps 372, though one or more clamps or fasteners may be employed to connect the single base 578 to the firearm 18 within the scope of the claimed invention.

Those skilled in the art will recognize that the desired dimensions of the scope mount apparatus will depend on the dimensions of the scope 14 to be used with the scope mount apparatus. For example, a scope with a larger objective lens may require walls 82, 182, 382, 384 that are taller than a scope with a smaller objective lens. Similarly, the diameter of the holes 66, 166, 366 of the scope rings 68, 168, 368 may vary depending on the diameter of the scope for which the scope mount apparatus is designed.

Referring to FIGS. 13-17, yet another scope mount apparatus 610 is depicted. The scope mount apparatus 610 is shown mounted to the firearm 18 in FIG. 13. The scope mount apparatus 610 in the embodiment depicted includes a first scope mount assembly 642 and a second scope mount assembly 646.

The first scope mount assembly 642 includes a first scope mount member 648. The first scope mount member 648 includes a first scope mount portion 654. More specifically, the upper surface 656 of the first scope mount member 648 defines a semi-cylindrical cavity 658. A first removable member 650 also includes a surface that defines another semi-cylindrical cavity 662.

The first removable member 650 is selectively attachable to the first scope mount member 648 such that the semi-cylindrical cavity 658 and the other semi-cylindrical cavity 662 cooperate to define a first cylindrical hole 666. In use, the scope 14 extends through the first cylindrical hole 666 between the first removable member 650 and the upper surface 656. The first scope mount portion 654 and the removeable member 650 thus cooperate to form a first scope ring 668.

Figure 13:
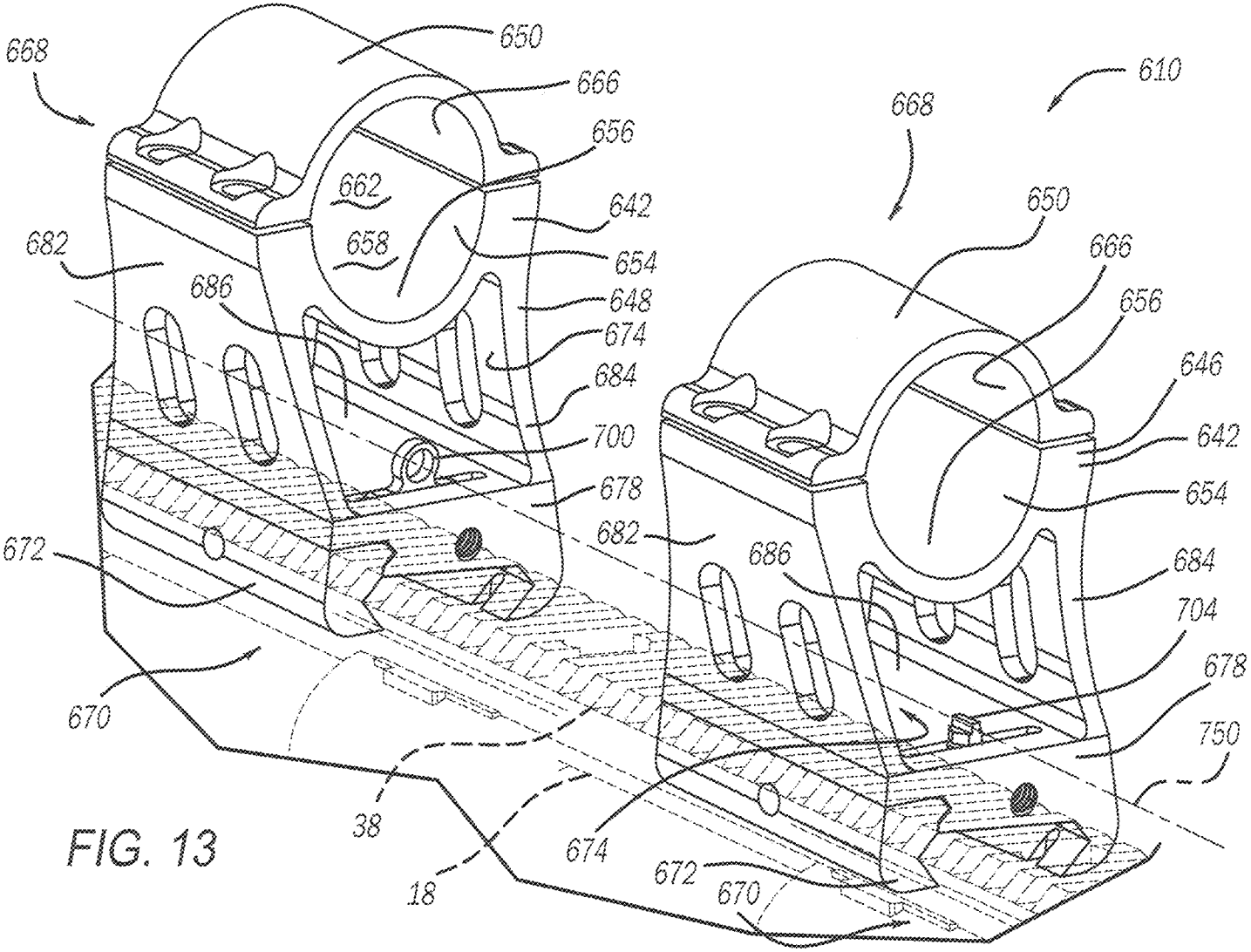
FIG. 13 is a schematic, perspective view of yet another scope mount apparatus in accordance with the claimed invention mounted to a firearm.

The first scope mount assembly 642 also includes a first fastening element 670 that is engageable with the accessory mounting system 38 to connect the first scope mount assembly 642 to the firearm 18 (as shown in FIG. 13). The first scope mount member 648 also defines a first aperture 674 between the first fastening element 670 and the scope mount portion 654. More specifically, the first scope first scope mount member 648 includes a first base portion 678 that, in the embodiment depicted, cooperates with the first fastening element 670 to interface with the accessory mounting system 38. Two walls 682, 684 extend vertically from the base portion 678 and interconnect the base portion 678 and the scope mount portion 654. The base portion 678, the scope mount portion 654, and the two walls 682, 684 define the first aperture 674 therebetween.

The second scope mount assembly 646 is identical to the first scope mount assembly 642 and includes the same features and elements as the first scope mount assembly 642. The scope mount apparatus 610 thus includes first and second scope rings (i.e., the scope ring 668 of the first scope mount 642 and the scope ring 668 of the second scope mount 646); at least one base (i.e., the base 678 of the first scope mount 642 and the base 678 of the second scope mount 646). At least one fastener 670 is operatively connected to the at least one base 678 and engageable with the accessory attachment system 38 of the firearm 18 to attach the at least one base 678 to the firearm 18.

In the embodiment depicted, the fastener 670 includes a clamp member 672 that cooperates with the base 678 to clamp onto the picatinny rail. More specifically, the clamp member 672 cooperates with the base 678 to define a cavity that captures the wide portion of the rail therein. The clamp member 672 is selectively movable with respect to the base 678 to permit entry of the rail into the cavity, and is securable with a threaded fastener (such as the one shown at 376 in FIG. 6) such that the rail is clamped between the base 678 and the clamp member 672 as shown in the Figures. However, those skilled in the art will recognize a variety of fasteners that may be employed to connect the scope mount apparatus with respect to a firearm within the scope of the claimed invention.

The scope mount apparatus 610 also includes structure (i.e., walls 682, 684 of the first scope mount 642, and the walls 682, 684 of the second scope mount 646) interconnecting the at least one base (i.e., the base 678 of the first scope mount 642 and the base 678 of the second scope mount 646) and first and second scope rings (i.e., the scope ring 668 of the first scope mount 642 and the scope ring 668 of the second scope mount 646).

A sighting system is mounted with respect to the at least one base. In the embodiment depicted, the sighting system is an "iron sight" system and includes a first iron sight member 700 mounted to the base 678 of the first scope mount 642 and a second iron sight member 704 mounted to the base 678 of the second scope mount 646. The sighting system (700, 704) is positioned such that, when the at least one fastener 672 is operatively connected to the accessory attachment element 38, a line 750 extends between the scope rings 668 and the at least one base portion 678 and extends through the sighting system 700, 704. An obstructed line of sight similar to the one shown at 216 in FIG. 1 extends through the apertures 674 parallel to line 750 and is unobstructed the length of the firearm, including the scope mounted to the scope rings 668.

The scope mount apparatus 610 includes first and second walls (682, 684 of the first scope mount 642) interconnecting a base (i.e., base 678 of the first scope mount 642) and the first scope ring (i.e., scope ring 668 of the first scope mount 642). Third and fourth walls (i.e., walls 682, 684 of the second scope mount 646) interconnect a second base (i.e., base 678 of the second scope mount 646) and the second scope ring (i.e., scope ring 668 of the second scope mount 646). The first wall, the second wall, the first base, and the first scope ring define a first aperture 674. The third wall, the fourth wall, the second base, and the second scope ring define a second aperture 674.

In the embodiment depicted, the sight members 700, 704 are removably mounted with respect to their respective bases 678. Each base 678 defines a respective planar surface 686 that partially defines the aperture 674. Each base member 678 defines a slot 708 having a slot opening 710 in the surface 686. Each base member 678 also defines a first threaded hole 714 having a hole opening 716 in the surface 686. The threaded hole 714 is partially coextensive with the slot 708.

Iron sight member 700 includes a plate portion 702 that extends into the slot 708 through the opening 710 in the surface 686 of the first scope mount assembly 642, as shown in FIGS. 13 and 15-17. Iron sight member 700 also includes a portion 703 that protrudes from the slot opening 710 into the aperture 674. The lateral dimension of the slot 708 is greater than the lateral dimension of portion 702 of the iron sight member 700. Thus, the iron sight member 700 is selectively slidable within the slot 708 such that the iron sight member 700 is selectively laterally movable relative to the base member 678. For example, and with reference to FIG. 16, the iron sight member 700 is movable laterally between the position shown at 700, and the positions shown in phantom at 700A and 700B.

The base member 678 defines a second threaded hole 718 extending perpendicularly to the first threaded hole 714 and being partially coextensive with the slot 708. A set screw 722 within the second threaded hole 718 abuts portion 702 of the iron sight member 700 within the slot 708. Thus, the set screw 722 may be tightened to lock the iron sight member 700 in a desired position, and the set screw 722 may be loosened to enable lateral movement of the iron sight member 700 relative to the base member 678.

Figure 14:
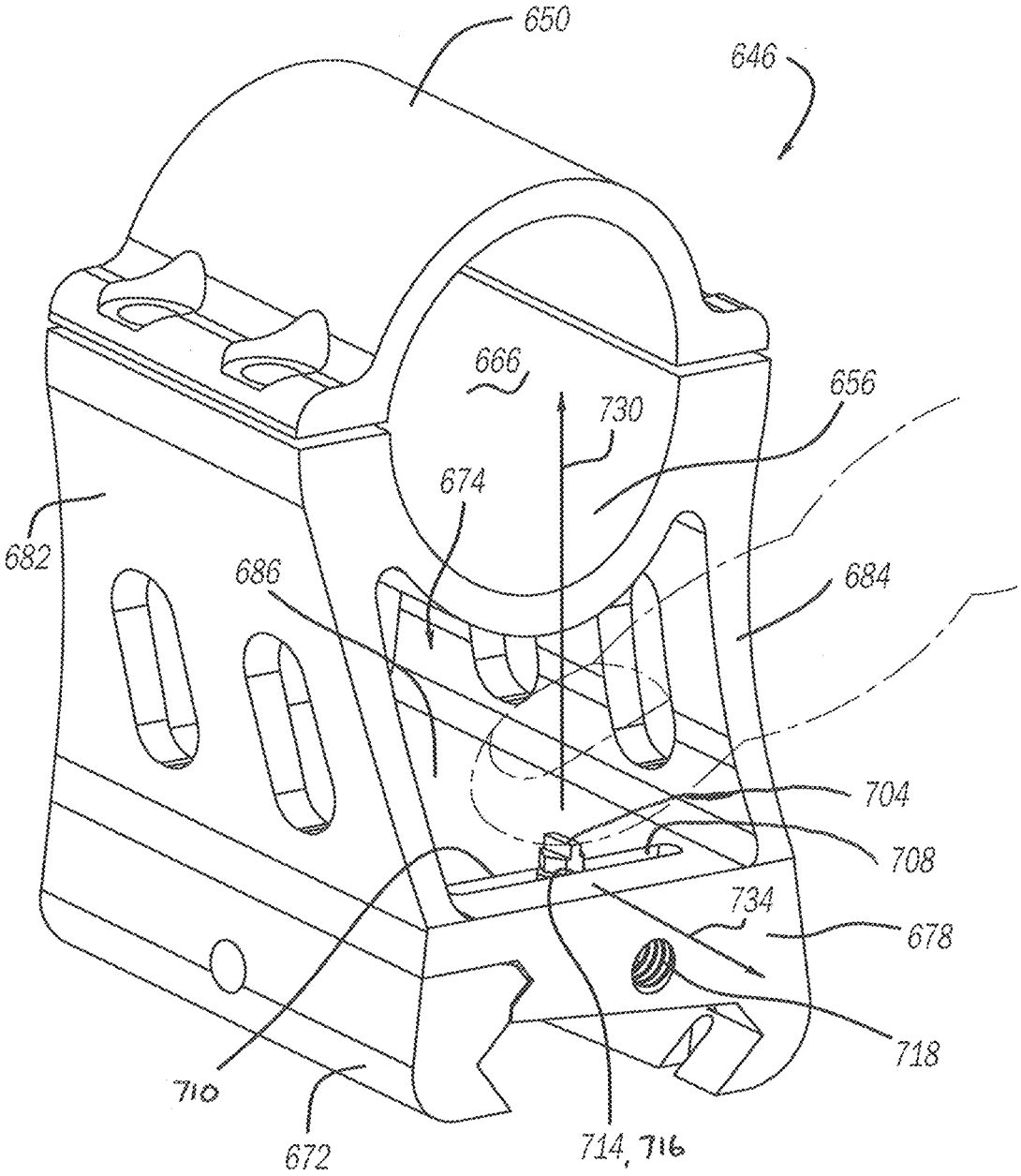
FIG. 14 is a schematic, perspective view of a scope ring assembly of the scope mount apparatus of FIG. 13.
Figure 15:
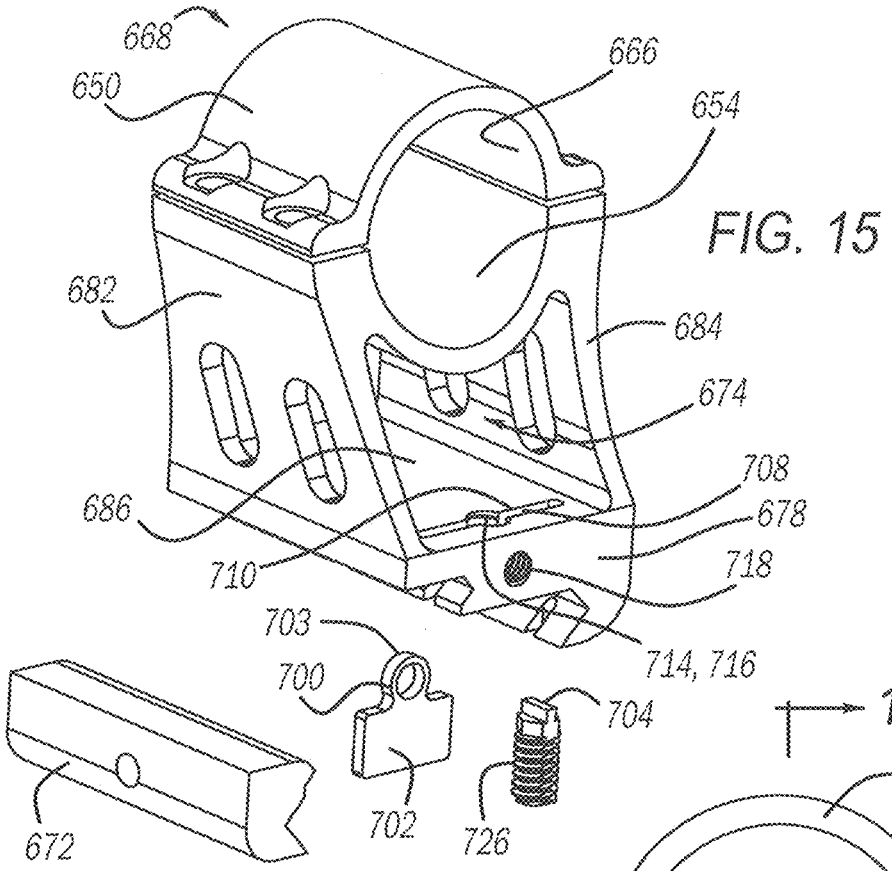
FIG. 15 is a schematic, exploded view of the scope ring assembly of FIG. 14 with iron sight members.
Figure 16:
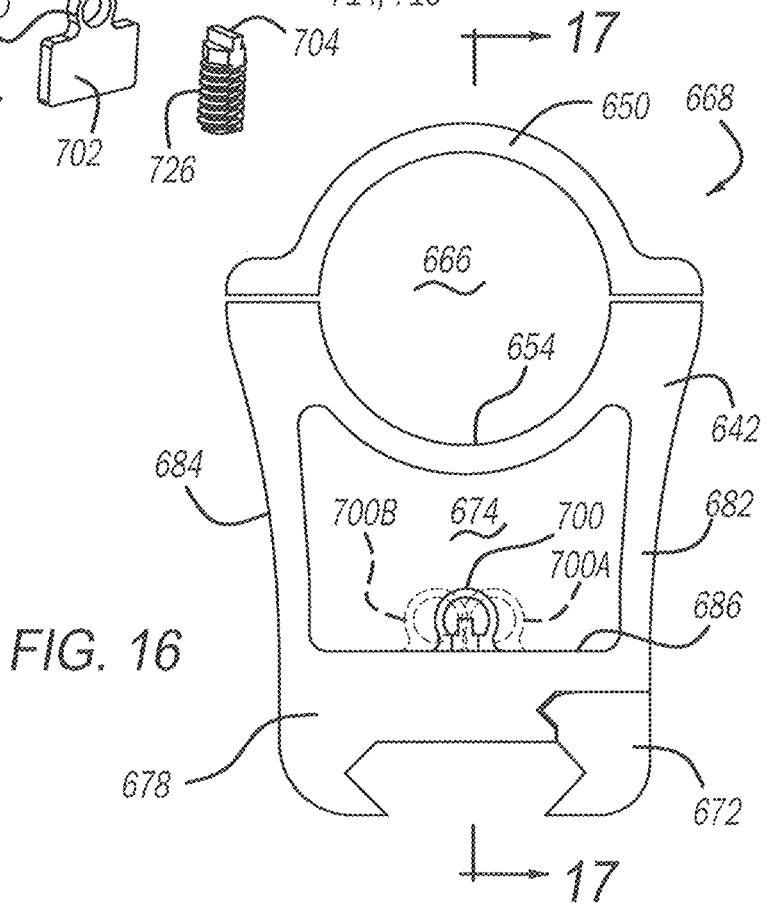
FIG. 16 is a schematic, rear view of the scope ring assembly of FIG. 14 with a rear iron sight installed thereon.
Figure 17:
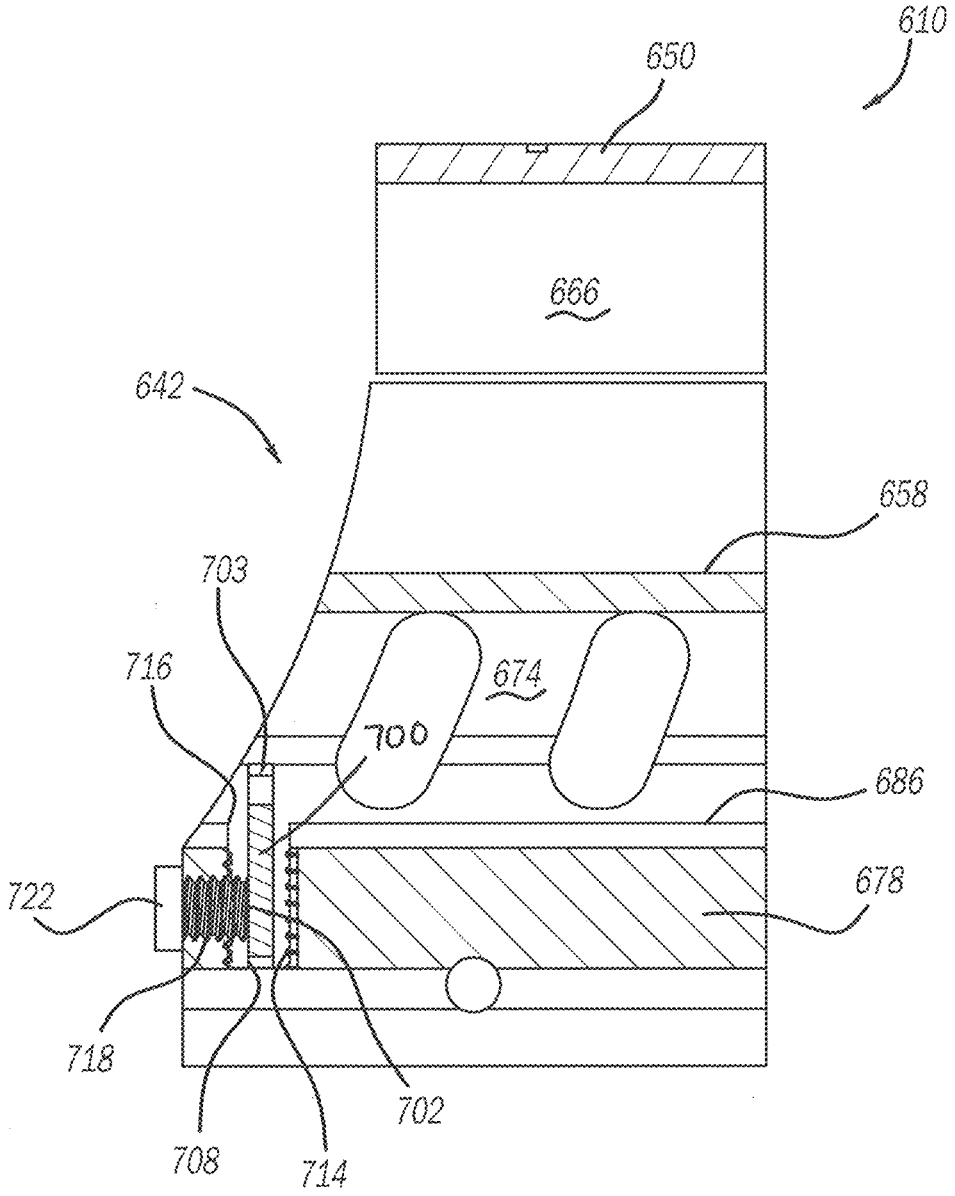
FIG. 17 is a schematic, sectional, side view of the scope ring assembly of FIG. 14 with the rear iron sight installed thereon.

The base member 678 of first scope mount assembly 642 is substantially identical to the base member 678 of the second scope mount assembly 646. Iron sight member 704 includes an externally threaded portion 726 engaged with the threaded hole 714 of the base member 678 of scope mount assembly 646, as shown in FIGS. 13 and 14. A portion of the iron sight member 704 protrudes from the surface 686 into the aperture 674.

The walls 682, 684 of both assemblies 642, 646 are tapered such that their lengths (i.e., dimension in the fore/aft direction) decrease with distance from surface 686, as shown in the Figures. When the assemblies 642, 646 are mounted to the firearm 18 and the firearm 18 is in the use position, the fore/aft dimension of the walls 682, 684 decreases as the height of the walls 682, 684 increases. This tapering of the walls 682, 684 results in the slots 708, holes 714, and any iron sight members 700, 704 therein being unobstructed by any structure, including but not limited to the scope rings 668, walls 682, 684, and the firearm 18, between two perpendicular directions (shown at 730, 734 in FIG. 14). When the firearm 18 is in the use position, direction 730 corresponds to the vertical, upward direction and direction 734 corresponds to the fore direction, i.e., toward the muzzle of the firearm 18. The tapered walls 682, 684 also reduce obstructions to the 708, holes 714, and any iron sight members 700, 704 therein in the transverse directions.

Figure 18:
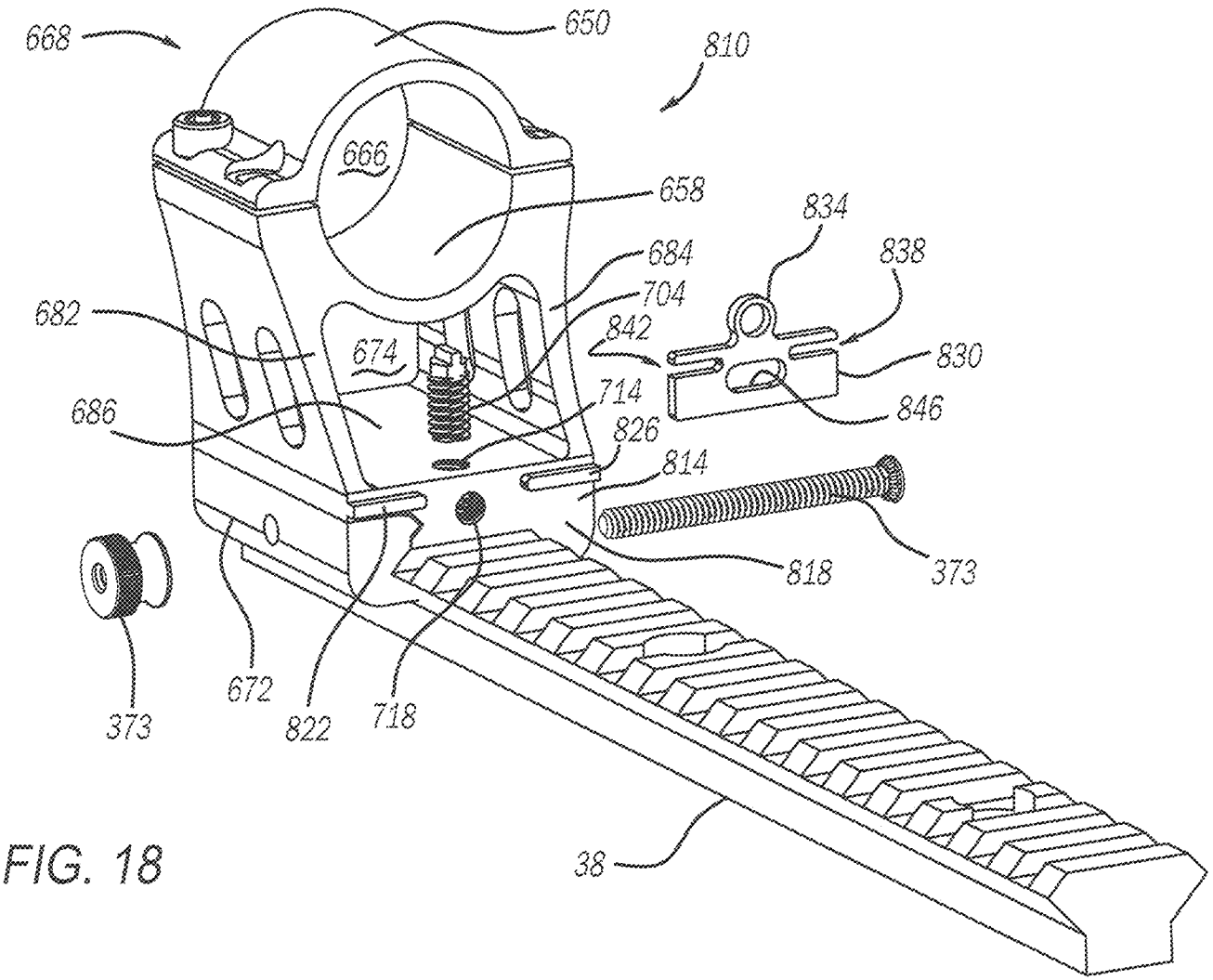
FIG. 18 is a schematic, perspective view of an alternative embodiment of the scope ring assembly of FIG. 14 mounted to the firearm.
Figure 19:
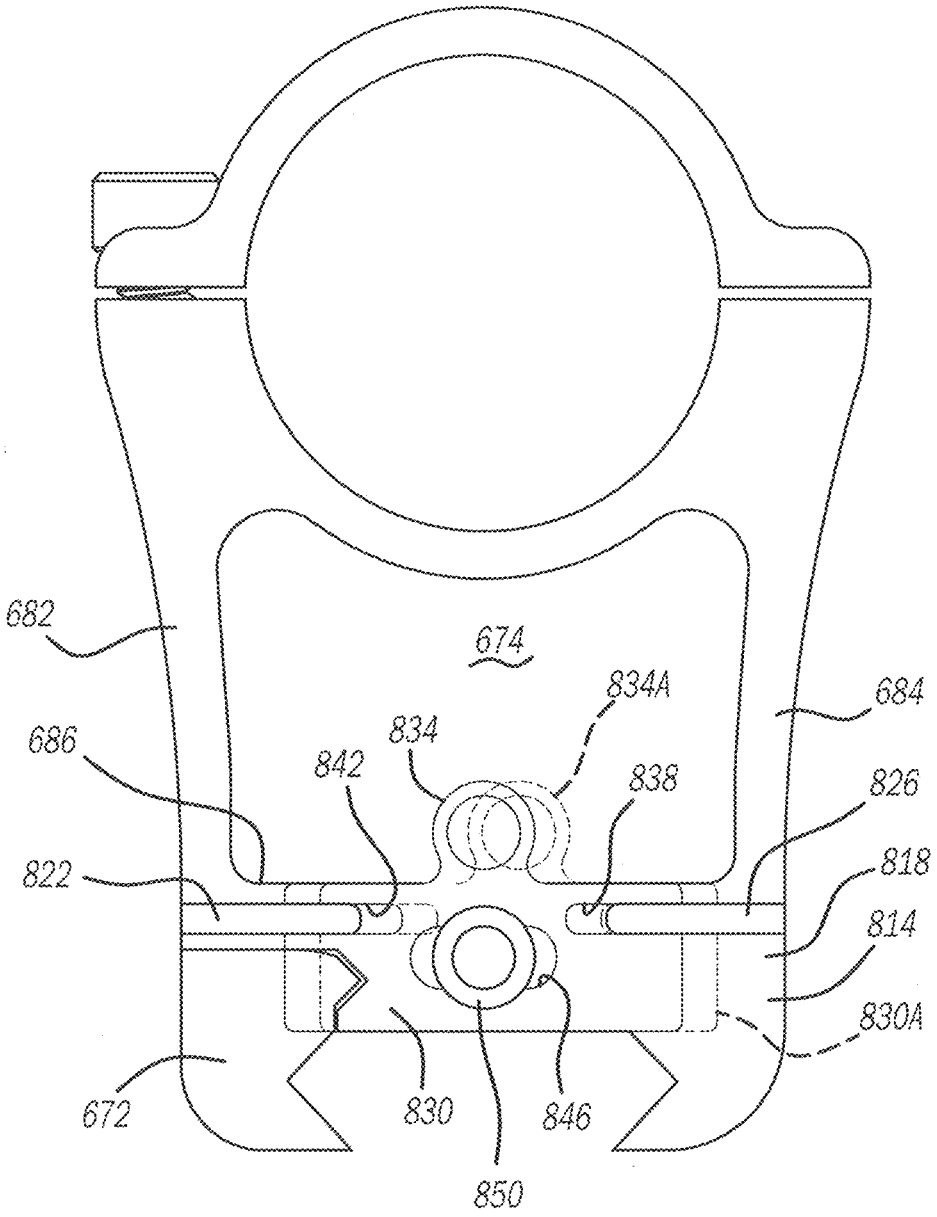
FIG. 19 is a schematic, front view of the scope ring assembly of FIG. 18 with a rear iron sight member mounted thereto.
Figure 20:
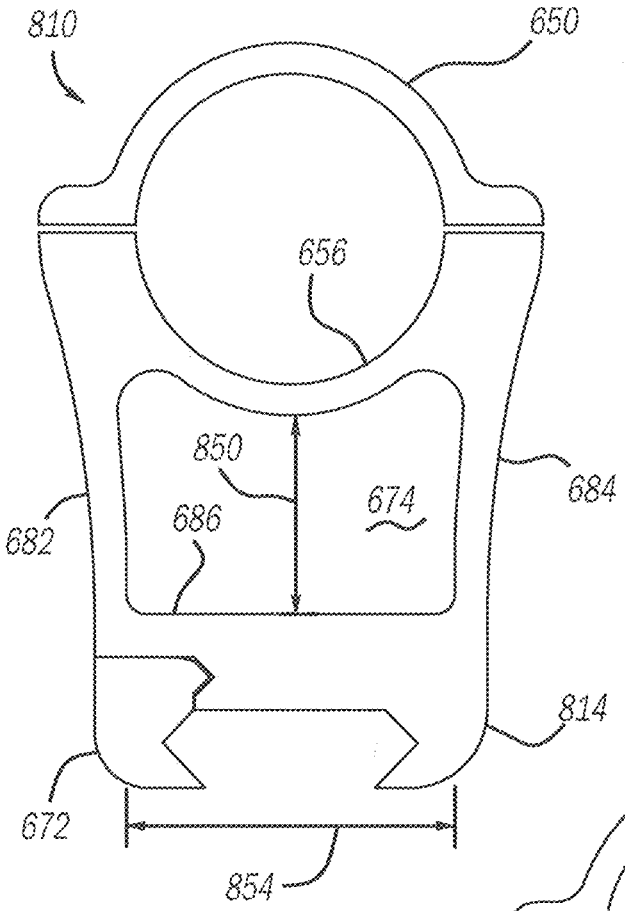
FIG. 20 is a schematic, front view of the scope ring assembly of FIG. 18.

Referring to FIGS. 18-20, wherein like reference numbers refer to like components from FIGS. 1-17, an alternative embodiment of a scope mount assembly 810 is schematically depicted. In use, two of the scope mount assemblies 810 would be mounted to the firearm 18 via the accessory mounting system 38 to replace scope mount assemblies 642, 646.

Scope mount assembly 810 is substantially identical to scope mount assemblies 642, 646 except that base member 814 does not define a slot like the one shown at 708 in FIG. 14 having an opening in surface 686. The base member 814 defines a surface 818 that is generally perpendicular to surface 686 and faces in the direction of the muzzle when attached to the firearm.

Surface 818 defines first and second protuberances 822, 826, which, in the embodiment depicted, are spaced apart from one another and elongated in the transverse direction. Iron sight member 830 includes a portion 834 that is configured to extend above surface 868 for use by a shooter for sighting in conjunction with iron sight member 704.

Iron sight member 830 defines first and second slots 838, 842. As shown in FIG. 19, the iron sight member 830 is mounted to surface 818 such that one of the protuberances 826 extends through slot 838 and the other protuberance 822 extends through slot 842. The protuberances 822, 826 and slots 838, 842 are positioned and dimensioned such that the protuberances 822, 826 are selectively slidable within the slots 838, 842 relative to the iron sight member 830.

The base member 814 defines a threaded hole 718 through the surface 818. Iron sight member 830 defines a third slot 846. Slot 846 is aligned with hole 718 and a threaded fastener such as a set screw 850 extends through the slot 846 to engage the hole 718. Tightening the screw 850 locks the iron sight member 830 relative to the base member 814. To adjust the lateral or transverse position of the iron sight member 830 relative to the base member 814, the screw 850 is loosened, and the iron sight member is moved, such as to the position shown in phantom at 830A in FIG. 19, which causes movement of the portion to the position shown in phantom at 834A. The screw 850 is then rotated for tightening and the iron sight member 830 is again locked relative to the base member 814.

It should be noted that the placement of the iron sight member 830 against surface 818 provides even more accessibility to a user for adjustment than the configuration shown for the iron sight member 700 because iron sight member 830 is unobstructed in even more directions that member 700. In use, an assembly 810 having iron sight member 830 would be attached to the firearm, and another assembly 810 having iron sight member 704 would be attached to the firearm forward of the assembly having iron sight member 830.

Referring specifically to FIG. 20, the minimum distance 850 between the scope ring 668 and the base member 814 is 0.605 inches. More specifically, the minimum distance 850 between the scope ring 668 and the surface 686, which forms the lower extend of aperture 674, is 0.605 inches, which has been found to be desirable to have an adequate field of view around the iron sight members (700 or 830) because the scope's objective lens (when installed within the scope rings 668) will obstruct at least some of the space between the scope rings and the base members, i.e., aperture 674. In one embodiment, when the scope is attached to the scope rings, there is a vertical distance of 0.033 between the objective lens of the scope and surface 686, which is achieved by having the 0.605 inch clearance. The width 854 of the aperture 674, i.e., the distance between walls 682, 284, is at least 1.063 inches in one embodiment.

A line of sight (such as the one shown at 216 in FIGS. 1 and 5) parallel to the longitudinal axis of the barrel 34 extends unobstructed through the apertures 674 of scope mount assemblies 642, 646, 810, and thus a shooter employing the firearm 18 has the option of using either the iron sight members (such as 700, 704, 830) or the scope 14. In other words, the scope mount apparatus 610, 810 is configured such that the line of sight 216 is unobstructed for the length of the firearm 18 when the scope 14 is attached to the scope rings 668.

The minimum clearance of 0.605 further ensures that, not only are the iron sights (700, 704, 830) usable with a scope 14 mounted to the scope mount assemblies (642, 646, 810), but that a shooter has an adequate field of view around the iron sights so that the iron sights (and the field of view around the iron sights) can be used for target locating and acquisition. A scope has a narrow field of view, and thus target locating and acquisition can be difficult. With the scope mount assemblies disclosed herein, a shooter can use the iron sights to locate a target, and then use the scope for final aiming prior to shooting.

Figure 21:
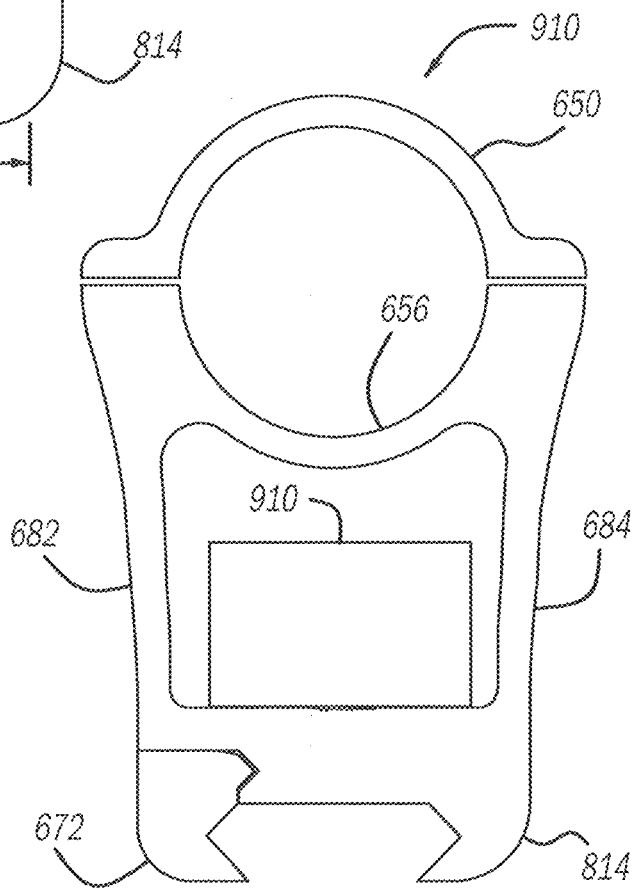
FIG. 21 is a schematic, front view of the scope ring assembly of FIG. 18 with a red dot sight or laser sight mounted thereto.

Referring to FIG. 21, wherein like reference numbers refer to like components from FIGS. 1-20, a scope ring assembly 910 is schematically depicted. The scope ring assembly 910 is substantially identical to scope ring assembly 810 except that scope ring assembly 910 includes a sighting system 910 that is mounted with respect to the base member 814 and at least partially within aperture 674.

Sighting system 910 may be either a red dot sight system or a laser sight system within the scope of the claimed invention. Red dot sights are disclosed in U.S. Pat. No. 7,234,265, issued Jun. 26, 2007 to Cheng et al.; and U.S. Pat. No. 5,493,450, issued Feb. 20, 1996 to Ekstrand, both of which are hereby incorporated by reference in their entireties. Laser sighting systems emit a laser beam that is reflected off the target so that a shooter knows the point of impact of a projectile and are known in the art. One example of a laser sighting system is disclosed in U.S. Pat. No. 4,313,273, issued Feb. 2, 1982 to Matthews et al, which is hereby incorporated by reference in its entirety.

While the best modes for carrying out the disclosure have been described in detail, those familiar with the art to which this disclosure relates will recognize various alternative designs and embodiments for practicing the disclosure within the scope of the appended claims.

The invention claimed is:

1. A scope mount apparatus for use with a firearm having a receiver, a barrel operatively connected to the receiver, and an accessory attachment element mounted to at least one of the receiver and barrel, the scope mount apparatus comprising:

first and second scope rings;

at least one base;

at least one fastener operatively connected to said at least one base and engageable with the accessory attachment element to attach said at least one base to the firearm;

structure interconnecting said at least one base and said first and second scope rings; and an iron sight system having a first iron sight member and a second iron sight member mounted with respect to said at least one base and not mounted to the firearm;

wherein the iron sight system is positioned such that, when said at least one fastener is operatively connected to the accessory attachment element, a line extends between the scope rings and said at least one base portion and extends through the iron sight system; and wherein the first iron sight member is selectively laterally movable relative to the at least one base.

2. The scope mount apparatus of claim 1, wherein said at least one base includes a first base defining a first surface and a second base defining a second surface;

wherein said at least one fastener includes a first fastener operatively connected to the first base and a second fastener operatively connected to the second base;

wherein said structure includes first and second walls interconnecting the first base and the first scope ring;

wherein said structure includes third and fourth walls interconnecting the second base and the second scope ring;

wherein the first wall, the second wall, the first surface, and the first scope ring define a first aperture;

wherein the third wall, the fourth wall, the second surface, and the second scope ring define a second aperture.

3. The scope mount apparatus of claim 2, wherein the minimum distance from the first surface to the first scope ring is 0.605 inches; and wherein the minimum distance from the second surface to the second scope ring is 0.605 inches.

4. The scope mount apparatus of claim 2, wherein the first iron sight member is unobstructed between two perpendicular directions.

5. The scope mount apparatus of claim 3, wherein the first and second walls are tapered such that their lengths decrease with distance from the first surface; and wherein the third and fourth walls are tapered such that their lengths decrease with distance from the second surface.

6. The scope mount apparatus of claim 2, wherein the first base defines a slot having a slot opening in the first surface; and wherein the first base defines a first threaded hole having a hole opening in the first surface; and wherein the threaded hole is partially coextensive with the slot.

7. The scope mount apparatus of claim 6, wherein the first iron sight member extends into the slot and protrudes from the slot opening into the first aperture.

8. The scope mount apparatus of claim 7, wherein the first iron sight member is selectively slidable within the slot such that the first iron sight member is selectively laterally movable relative to the first base.

9. The scope mount apparatus of claim 8, wherein the first base defines a second threaded hole extending perpendicularly to the first threaded hole and being partially coextensive with the slot; and a set screw within the second threaded hole and abutting the first iron sight member within the slot.

10. The scope mount apparatus of claim 8, wherein the second base is substantially identical to the first base, and wherein the second iron sight member includes an externally threaded portion engaged with the threaded hole of the second base.

11. The scope mount apparatus of claim 5, wherein the first base defines a third surface that is generally perpendicular to the first surface; and wherein the first iron sight member is mounted to the third surface.

12. The scope mount apparatus of claim 11, wherein the third surface defines first and second protuberances;

wherein the first iron sight member defines first and second slots;

wherein the first protuberance extends through the first slot;

wherein the second protuberance extends through the second slot; and wherein the protuberances are selectively slidable relative to the slots.

13. The scope mount apparatus of claim 12, wherein the first base defines a threaded hole through the third surface;

wherein the first iron sight member defines a third slot; and wherein the scope mount apparatus includes a set screw extending through the third slot and the threaded hole.

14. A scope mount apparatus for use with a firearm having a receiver, a barrel operatively connected to the receiver, and an accessory attachment element mounted to at least one of the receiver and barrel, the scope mount apparatus comprising:

first and second scope rings;

at least one base;

at least one fastener operatively connected to said at least one base and engageable with the accessory attachment element to attach said at least one base to the firearm;

structure interconnecting said at least one base and said first and second scope rings; and a sighting system selected from the group consisting of laser sights and red dot sights;

wherein the sighting system is positioned such that, when said at least one fastener is operatively connected to the accessory attachment element, a line extends between the scope rings and said at least one base portion and extends through the sighting system.

15. The scope mount apparatus of claim 14, wherein said at least one base includes a first base defining a first surface and a second base defining a second surface;

wherein said at least one fastener includes a first fastener operatively connected to the first base and a second fastener operatively connected to the second base;

wherein said structure includes first and second walls interconnecting the first base and the first scope ring;

wherein said structure includes third and fourth walls interconnecting the second base and the second scope ring;

wherein the first wall, the second wall, the first surface, and the first scope ring define a first aperture;

wherein the third wall, the fourth wall, the second surface, and the second scope ring define a second aperture.

16. The scope mount apparatus of claim 15, wherein the minimum distance from the first surface to the first scope ring is 0.605 inches; and wherein the minimum distance from the second surface to the second scope ring is 0.605 inches.

* * * * *